US009586407B2

(12) United States Patent
Kimura et al.

(10) Patent No.: US 9,586,407 B2
(45) Date of Patent: Mar. 7, 2017

(54) LIQUID CONTAINER, LIQUID CONTAINER UNIT, LIQUID EJECTION SYSTEM AND LIQUID EJECTION APPARATUS

(71) Applicant: SEIKO EPSON CORPORATION, Tokyo (JP)

(72) Inventors: Naomi Kimura, Nagano (JP); Shoma Kudo, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/779,035

(22) PCT Filed: Dec. 9, 2014

(86) PCT No.: PCT/JP2014/006151

§ 371 (c)(1),
(2) Date: Sep. 22, 2015

(87) PCT Pub. No.: WO2015/107595

PCT Pub. Date: Jul. 23, 2015

(65) Prior Publication Data

US 2016/0052286 A1 Feb. 25, 2016

(30) Foreign Application Priority Data

Jan. 14, 2014 (JP) ..... 2014-003960

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.
CPC ..... *B41J 2/17523* (2013.01); *B41J 2/1752* (2013.01); *B41J 2/17509* (2013.01);
(Continued)

(58) Field of Classification Search
CPC .. B41J 2/17513; B41J 2/1752; B41J 2/17523; B41J 2/17553; B41J 2/17556
(Continued)

(56) References Cited

U.S. PATENT DOCUMENTS

2004/0001128 A1* 1/2004 Hung ..... B41J 2/17556 347/86
2005/0270347 A1* 12/2005 Yamamoto ..... B41J 2/17566 347/86

(Continued)

FOREIGN PATENT DOCUMENTS

CN 201099042 Y 8/2008
JP 2011-177994 A 9/2011

(Continued)

*Primary Examiner* — Justin Seo
*Assistant Examiner* — Roger W Pisha, II
(74) *Attorney, Agent, or Firm* — Global IP Counselors, LLP

(57) ABSTRACT

A liquid container includes: a container portion that is configured to contain ink; and an ink inlet portion that is connected with the container portion and is configured to pour ink into the container portion. The container portion includes a fifth wall that is arranged to intersect with the ink inlet portion; a third wall that has optical transparency and is arranged to intersect with the fifth wall; and a partition wall that is located between the third wall and an intersecting part at which the ink inlet portion intersects with the fifth wall.

8 Claims, 20 Drawing Sheets

(52) U.S. Cl.
CPC ..... *B41J 2/17553* (2013.01); *B41J 29/02* (2013.01); *B41J 29/13* (2013.01)

(58) Field of Classification Search
USPC ..... 347/84–86
See application file for complete search history.

(56) References Cited

U.S. PATENT DOCUMENTS

| | | | | |
|---|---|---|---|---|
| 2011/0069126 | A1* | 3/2011 | Feng | B41J 2/17513 347/87 |
| 2011/0249064 | A1* | 10/2011 | Wang | B41J 2/17513 347/86 |
| 2011/0267408 | A1 | 11/2011 | Aoi et al. | |
| 2012/0038719 | A1 | 2/2012 | Shimizu et al. | |
| 2013/0235126 | A1* | 9/2013 | Takeuchi | B41J 2/175 347/85 |
| 2014/0104349 | A1 | 4/2014 | Kimura et al. | |
| 2015/0124028 | A1 | 5/2015 | Kimura et al. | |

FOREIGN PATENT DOCUMENTS

| | | | |
|---|---|---|---|
| JP | 2011-235440 | A | 11/2011 |
| JP | 2011-235441 | A | 11/2011 |
| JP | 2012-020495 | A | 2/2012 |
| JP | 2012-051309 | A | 3/2012 |

* cited by examiner

LIQUID CONTAINER, LIQUID CONTAINER UNIT, LIQUID EJECTION SYSTEM AND LIQUID EJECTION APPARATUS

TECHNICAL FIELD

The present invention relates to a liquid container, a liquid container unit, a liquid ejection system, a liquid ejection apparatus and the like.

BACKGROUND ART

An inkjet printer has conventionally been known as one example of a liquid ejection apparatus. The inkjet printer ejects ink as one example of a liquid from an ejection head onto a printing medium such as printing paper, so as to implement printing on the printing medium. A known configuration of the inkjet printer causes ink stored in a tank as one example of a liquid container to be supplied to the ejection head. This tank is provided with an ink inlet port. The user is allowed to refill ink from the ink inlet port into the tank (see, for example, Patent Literature 1). In the description below, the configuration that the liquid container such as tank is added to the liquid ejection apparatus such as inkjet printer may be called liquid ejection system.

CITATION LIST

Patent Literature

PTL 1: JP 2012-51309A

SUMMARY

Technical Problem

The tank described in Patent Literature 1 has a translucent tank main body. This configuration enables the user to visually check the amount of ink contained in the tank from outside. The tank has an upper limit line provided in part of wall portions constituting the tank main body. This configuration enables the user to pour ink from an inlet port into the tank, while visually checking the amount of ink contained in the tank via the wall portion with the upper limit line. The wall portion with the upper limit line is called visual recognition portion. When the liquid level of ink contained in the tank reaches the upper limit line, the user can recognize that the amount of ink in the tank reaches its upper limit. In the tank described in Patent Literature 1, however, the visual recognition portion is located near to the inlet port. When ink is poured from the inlet port into the tank, the poured ink may thus adhere to the visual recognition portion inside of the tank. This deteriorates the visibility of the visual recognition portion and makes it difficult for the user to recognize the amount of ink contained in the tank. Accordingly, the conventional liquid container has difficulty in recognizing the amount of the liquid.

Solution to Problem

In order to solve at least part of the problems described above, the invention may be implemented by the following aspects or embodiments.

[Aspect 1]

A liquid container comprises a liquid container portion that is configured to contain a liquid; and a liquid inlet portion that is connected with the liquid container portion and is configured to pour the liquid into the liquid container portion. The liquid container portion includes a first wall portion that is arranged to intersect with the liquid inlet portion; a second wall portion that has optical transparency and is arranged to intersect with the first wall portion; and a partition wall that is located between the second wall portion and an intersecting part at which the liquid inlet portion intersects with the first wall portion.

In the liquid container of this aspect, the partition wall interferes with the flow of the liquid from the liquid inlet portion toward the second wall portion when the liquid is poured from the liquid inlet portion into the liquid container portion. This configuration reduces the likelihood that the liquid adheres to the second wall portion even when the liquid is splashed from the liquid inlet portion toward the second wall portion. This facilitates the amount of the liquid contained in the liquid container to be recognized via the second wall portion.

[Aspect 2]

In the liquid container of the above aspect, the liquid container portion may include a bottom wall that is located below the first wall portion in a state that the liquid container portion contains the liquid, and the partition wall may be extended in a direction from the first wall portion toward the bottom wall.

This aspect facilitates the wide area of the second wall portion to be blocked from the liquid inlet portion and thus makes the partition wall likely to interfere with the flow of the liquid from the liquid inlet portion toward the second wall portion.

[Aspect 3]

In the liquid container of the above aspect, the liquid container portion may include a third wall portion that is arranged to intersect with the first wall portion and the second wall portion; and a fourth wall portion that is arranged to intersect with the first wall portion and the second wall portion. The partition wall may be a projection that is protruded from the third wall portion, and a clearance may be formed between at least part of the partition wall and the first wall portion.

This aspect makes the air trapped in a space surrounded by the first wall portion, the second wall portion, the partition wall, the third wall portion and the fourth wall portion likely to be released through the clearance between the partition wall and the first wall portion during pouring of the liquid from the liquid inlet portion into the liquid container portion. Accordingly, the liquid level in the space surrounded by the first wall portion, the second wall portion, the partition wall, the third wall portion and the fourth wall portion is likely to adequately rise according to the amount of the liquid poured form the liquid inlet portion. Accordingly this enables the amount of the liquid contained in the liquid container portion to be recognized accurately.

[Aspect 4]

In the liquid container of the above aspect, the liquid container portion may include a third wall portion that is arranged to intersect with the first wall portion and the second wall portion; and a fourth wall portion that is arranged to intersect with the first wall portion and the second wall portion. The partition wall may be a projection that is protruded from the third wall portion, and a clearance may be formed between at least part of the partition wall and the fourth wall portion.

This aspect makes the air trapped in a space surrounded by the first wall portion, the second wall portion, the partition wall, the third wall portion and the fourth wall portion likely to be released through the clearance between the partition wall and the fourth wall portion during pouring of the liquid from the liquid inlet portion into the liquid container portion. Accordingly, the liquid level in the space surrounded by the first wall portion, the second wall portion, the partition wall, the third wall portion and the fourth wall portion is likely to adequately rise according to the amount of the liquid poured form the liquid inlet portion. Accordingly this enables the amount of the liquid contained in the liquid container portion to be recognized accurately.

[Aspect 5]

In the liquid container of the above aspect, a distance between one end of the partition wall on the intersecting part-side and the second wall portion may be less than a distance between the other end of the partition wall on an opposite side to the intersecting part side and the second wall portion.

In this aspect, the partition wall is arranged to be away from the second wall portion in a direction from one end on the intersecting part side to the other end. This configuration makes the liquid poured from the liquid inlet port likely to be away from the second wall portion and thereby reduces the likelihood that the liquid adheres to the second wall portion.

[Aspect 6]

In the liquid container of the above aspect, at least part of the partition wall may be located vertically below the intersecting part in a state that the liquid is poured through the liquid inlet portion.

In this aspect, the partition wall serves to reduce the impact of liquid dripping when the liquid poured from the liquid inlet portion drips down in the vertical direction from the intersecting part. This accordingly reduces the splash of the dripping liquid. As a result, this further reduces the likelihood that the liquid adheres to the second wall portion.

[Aspect 7]

In the liquid container of the above aspect, the partition wall may have a cylindrical structure, and the cylindrical structure may be extended from the intersecting part.

In this aspect, the cylindrical structure is likely to suppress the liquid from being splashed toward the second wall portion when the liquid is poured into the liquid container. As a result, this further reduces the likelihood that the liquid adheres to the second wall portion.

[Aspect 8]

In the liquid container of the above aspect, a material having liquid repellency against the liquid may be applied on an inner wall of the second wall portion.

In this aspect, even when the liquid adheres to the second wall portion, the second wall portion is likely to repel the liquid. This is likely to maintain the visibility through the second wall portion and thereby further facilitates the amount of the liquid contained in the liquid container to be recognized via the second wall portion.

[Aspect 9]

A liquid container unit comprises a cover, a support structure, and the liquid container according to any one of the above aspects 1 to 8 that is located between the cover and the support structure.

In the liquid container unit having the liquid container located between the cover and the support structure, this aspect facilitates the amount of the liquid contained in the liquid container to be recognized.

[Aspect 10]

A liquid ejection system comprises the liquid container unit of the above aspect; a liquid ejection apparatus having a liquid ejection head; and a tube that is arranged to supply the liquid from the liquid container of the liquid container unit to the liquid ejection head. The liquid container unit is fixed to outer periphery of the liquid ejection apparatus.

In the liquid ejection system including the liquid container unit, the liquid ejection apparatus and the tube, this aspect facilitates the amount of the liquid contained in the liquid container to be recognized.

[Aspect 11]

A liquid ejection apparatus comprises a cover; a support structure; the liquid container of any one of the above aspects that is located between the cover and the support structure; a liquid ejection head that is provided between the cover and the support structure; and a tube that is provided between the cover and the support structure and is arranged to supply the liquid from the liquid container to the liquid ejection head.

In the liquid ejection apparatus including the liquid container, the liquid ejection head and the tube, this aspect facilitates the amount of the liquid contained in the liquid container to be recognized.

DESCRIPTION OF EMBODIMENTS

The following describes a liquid ejection system including an inkjet printer (hereinafter called printer) as one example of the liquid ejection apparatus according to one aspect with reference to the drawings. The respective drawings may employ different scales to show the respective configurations and members in recognizable sizes.

[First Aspect]

Figure 1:
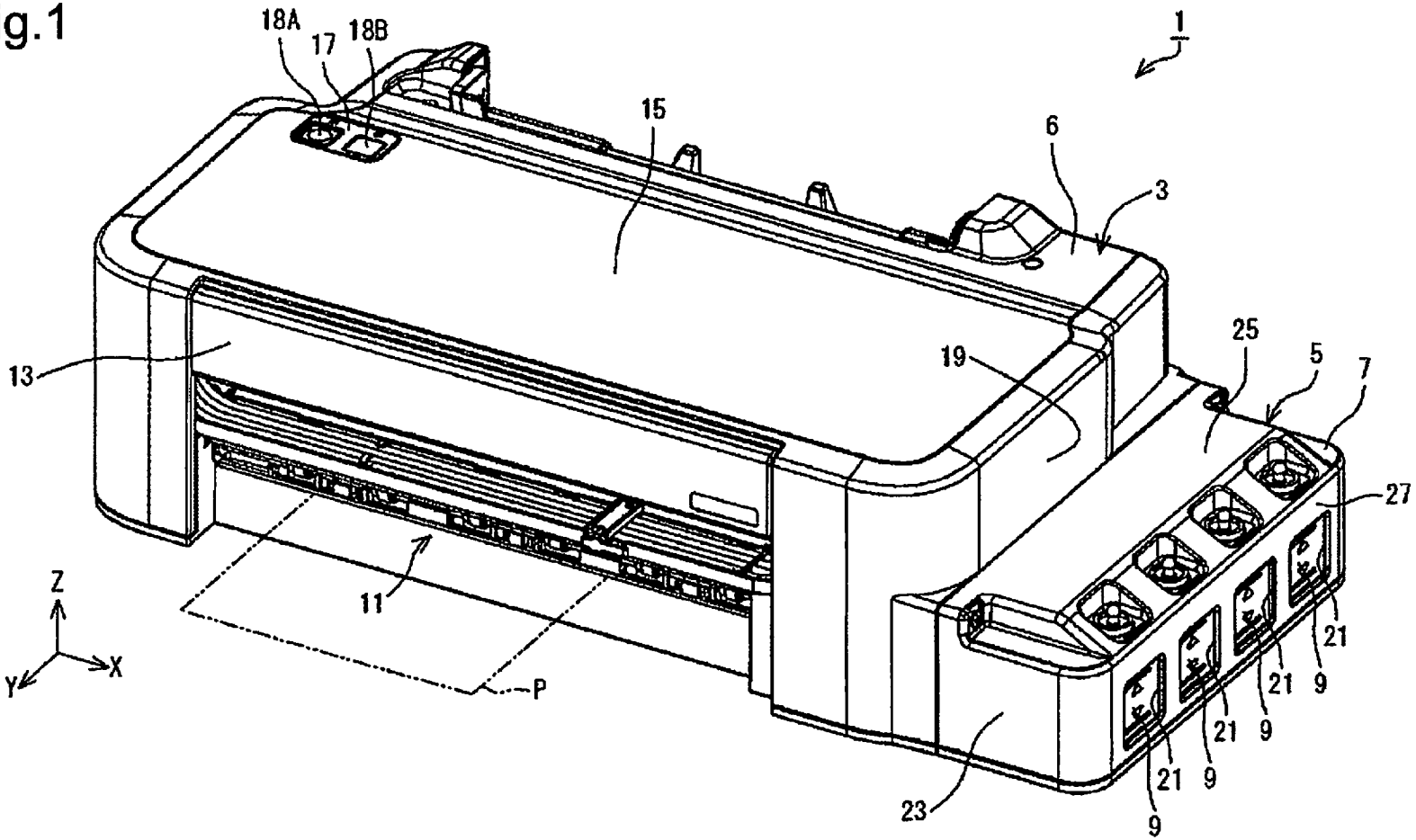
FIG. 1 is a perspective view illustrating a liquid ejection system according to a first aspect.

As shown in FIG. 1, a liquid ejection system 1 according to a first aspect includes a printer 3 as one example of the liquid ejection apparatus and a tank unit 5. The printer 3 has a first casing 6. The first casing 6 forms the outer shell of the printer 3. The tank unit 5 has a second casing 7 and a plurality of (two or more) tanks 9. The first casing 6 and the second casing 7 form the outer shell of the liquid ejection system 1. The tank 9 is one example of the liquid container. The liquid ejection system 1 is configured to perform printing on a printing medium P such as printing paper with ink as one example of the liquid.

XYZ axes as coordinate axes that are orthogonal to one another are shown in FIG. 1. The XYZ axes are also added as appropriate in subsequent drawings. With respect to each of the XYZ axes, the direction of arrow represents+direction (positive direction), and the opposite direction to the direction of arrow represents−direction (negative direction). In the use state of the liquid ejection system 1, the liquid ejection system 1 is placed on a horizontal plane defined by the X axis and the Y axis. In the use state of the liquid ejection system 1, the Z axis is the axis orthogonal to the horizontal plane, and the −Z-axis direction is downward in the vertical direction.

A mechanism unit 10 (shown in FIG. 10) of the printer 3 is placed in the first casing 6. The mechanism unit 10 is a mechanism part configured to perform a printing operation in the printer 3. The details of the mechanism unit 10 will be described later. As shown in FIG. 1, the plurality of tanks 9 are placed in the second casing 7 and are respectively provided to contain inks used for printing. According to this aspect, four tanks 9 are provided. The four tanks 9 respectively contain different inks. This aspect employs four different inks, i.e., black, yellow, magenta and cyan. There are one tank 9 to contain black ink, one tank 9 to contain yellow ink, one tank 9 to contain magenta ink and one tank 9 to contain cyan ink. In the liquid ejection system 1, the plurality of tanks 9 are placed outside of the first casing 6. Accordingly, in the liquid ejection system 1, the plurality of tanks 9 are not placed inside of the first casing 6 arranged to cover the mechanism unit 10.

The printer 3 is provided with a paper ejection portion 11. In the printer 3, the printing medium P is discharged from the paper ejection portion 11. In the printer 3, a surface where the paper ejection portion 11 is located is a front surface 13. The printer 3 also has an operation panel 17 on a top surface 15 intersecting with the front surface 13. The operation panel 17 includes a power button 18A and other operation buttons 18B. The tank unit 5 is provided on a side surface 19 of the first casing 6 intersecting with the front surface 13 and the top surface 15. The second casing 7 has windows 21. The windows 21 are provided on a side surface 27 of the second casing 7 intersecting with its front surface 23 and top surface 25. The windows 21 have optical transparency. The four tanks 9 described above are provided at positions overlapping the windows 21. This enables the operator using the liquid ejection system 1 to visually check the four tanks 9 via the windows 21. According to this aspect, the windows 21 are provided as openings formed in the second casing 7. The operator can visually check the four tanks 9 via the windows 21 that are the openings. The windows 21 are, however, not limited to the openings but may be made of a material having optical transparency.

Figure 2:
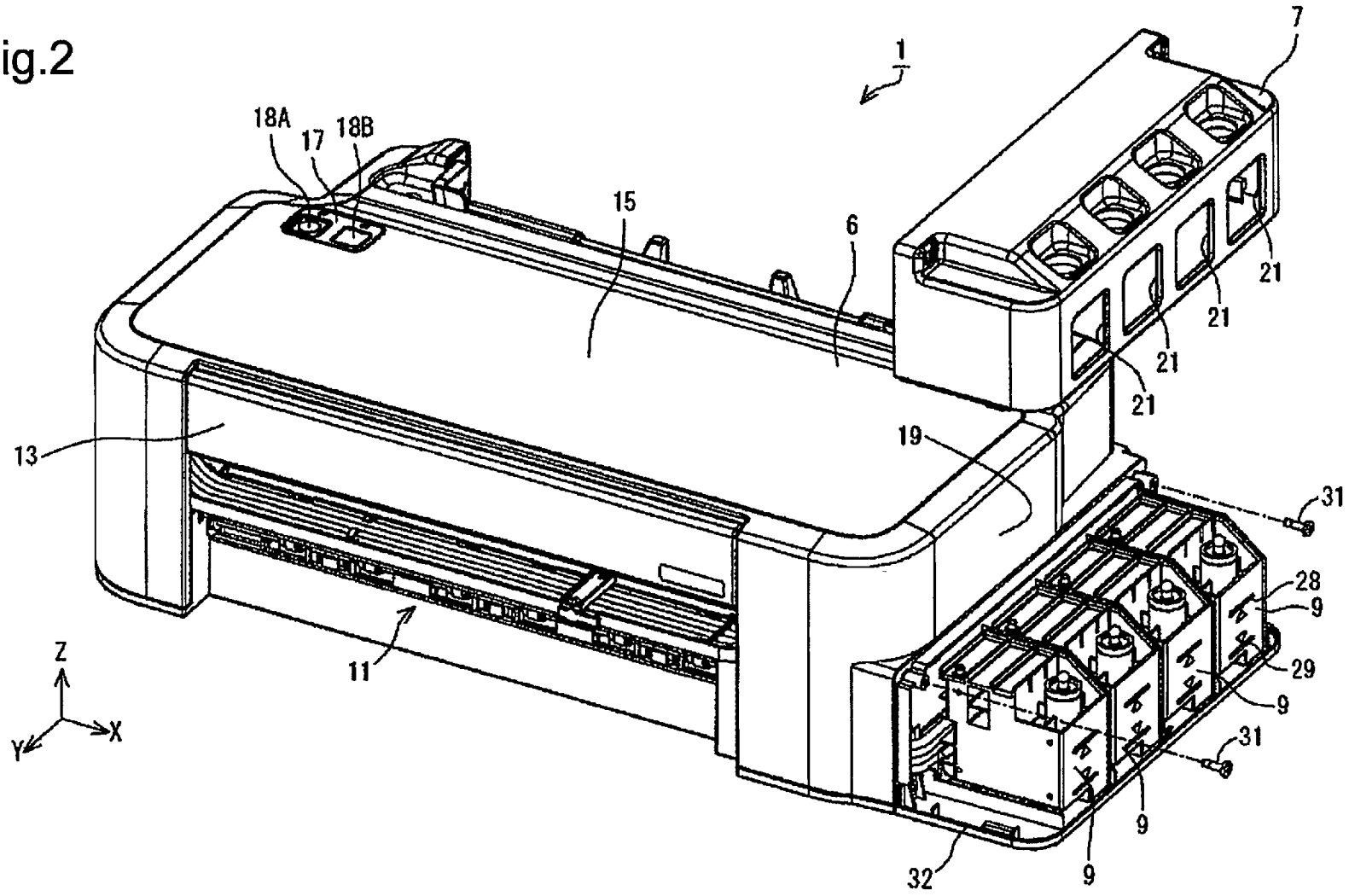
FIG. 2 is a perspective view illustrating the liquid ejection system of the first aspect.

According to this aspect, at least part of an area of each tank 9 facing the window 21 has optical transparency. The ink contained in the tank 9 is visible through this area of each tank 9 having optical transparency. Accordingly, this enables the operator to visually recognize the four tanks 9 via the windows 21 and thereby visually check the amounts of inks in the respective tanks 9. In other words, at least part of the area of the tank 9 facing the window 9 serves as the visual recognition portion from which the amount of ink is visible. Each tank 9 has an upper limit mark 28 indicating an upper limit of ink amount and a lower limit mark 29 indicating a lower limit of ink amount, in the area facing the window 21. The operator recognizes the amount of ink remaining in each tank 9 using the upper limit mark 28 and the lower limit mark 29 as indications. The first casing 6 and the second casing 7 are provided as separate members. According to this aspect, the second casing 7 is thus separable from the first casing 6 as shown in FIG. 2. The second casing 7 is joined with the first casing 6 by means of mounting screws 31. The second casing 7 covers at least part of the four tanks 9, for example, the front surface, the top surface and the side surface as shown in FIG. 2.

Figure 3:
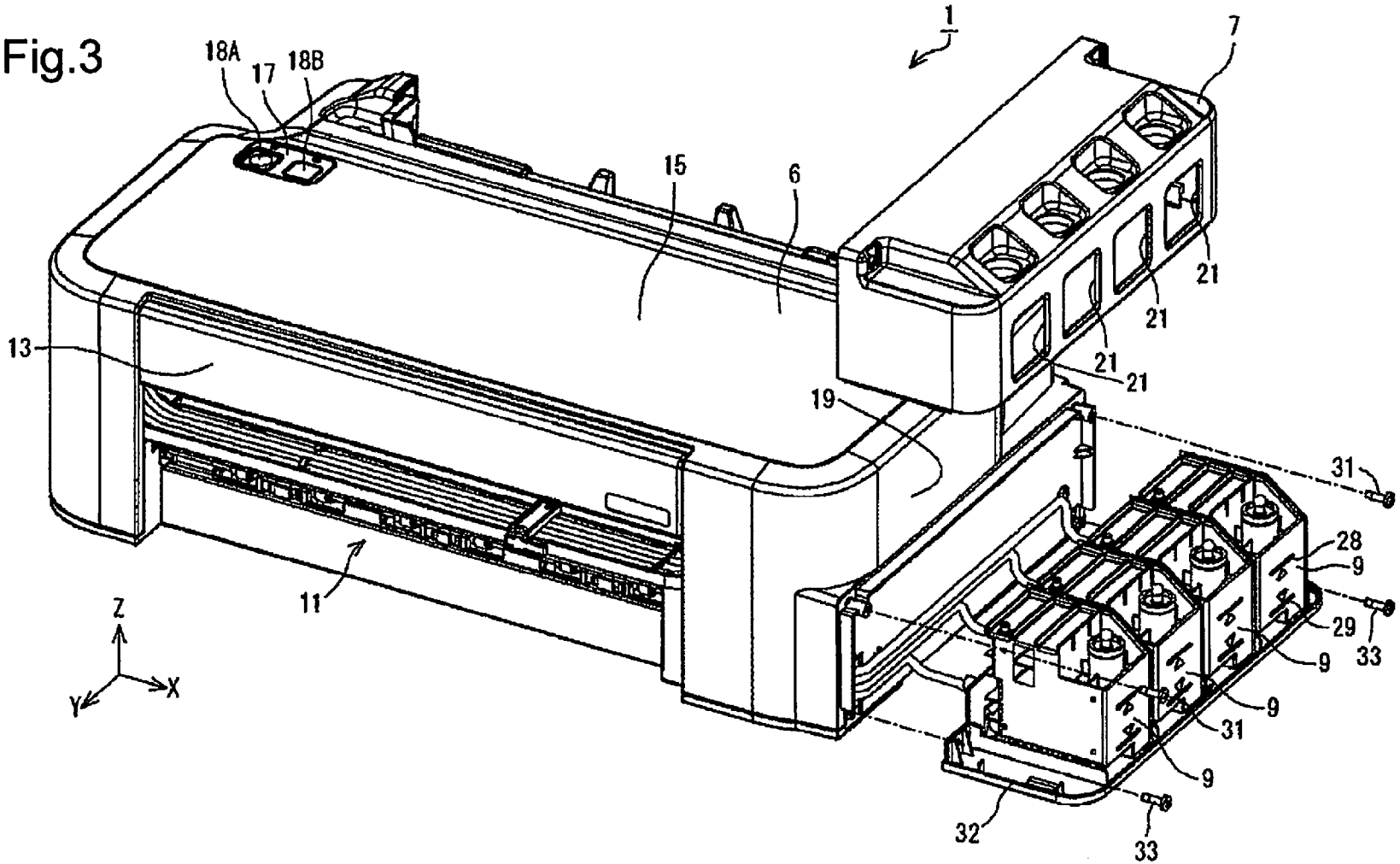
FIG. 3 is a perspective view illustrating the liquid ejection system of the first aspect.

The tank unit 5 has a support frame 32. The four tanks 9 are supported by the support frame 32. The support frame 32 is provided as a separate member from the first casing 6. According to this aspect, the support frame 32 is thus separable from the first casing 6 as shown in FIG. 3. The support frame 32 is joined with the first casing 6 by means of mounting screws 33. As described above, the tank unit 5 (shown in FIG. 1) is mounted to the outside of the first casing 6 according to this aspect.

Figure 4:
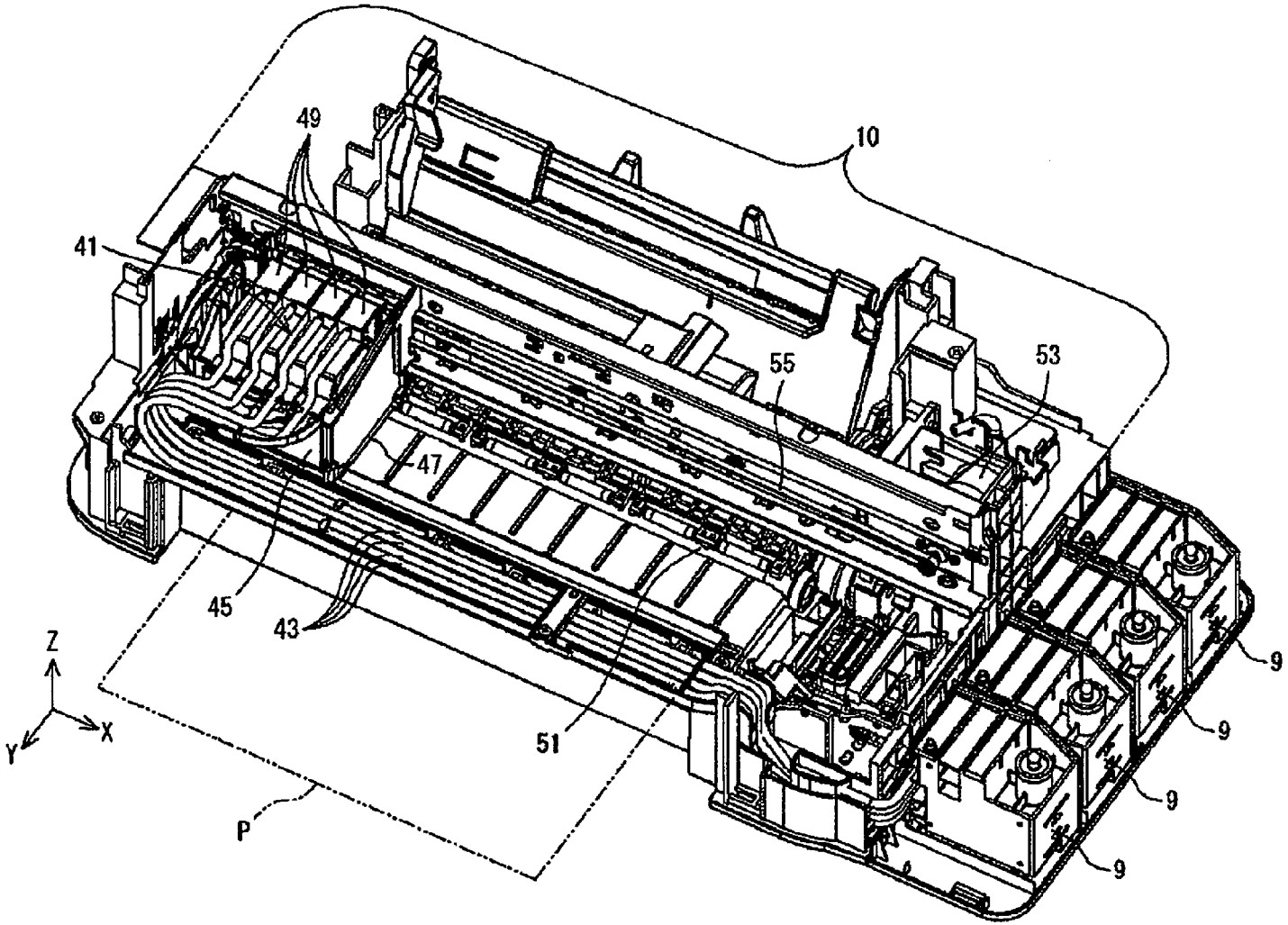
FIG. 4 is a perspective view illustrating a mechanism unit of a printer according to the first aspect.

As shown in FIG. 4 that is a perspective view illustrating the mechanism unit 10, the printer 3 includes a printing assembly 41 and supply tubes 43. The printing assembly 41 includes a carriage 45, a print head 47 and four relay units 49. The print head 47 and the four relay units 49 are mounted on the carriage 45. The supply tubes 43 are flexible and are provided between the tanks 9 and the relay units 49. The ink contained in the tank 9 is supplied through the supply tube 43 to the relay unit 49. The relay unit 49 transfers the ink which is supplied from the tank 9 through the supply tube 32, to the print head 47. The print head 47 ejects the supplied ink in the form of ink droplets.

The printer 3 also has a medium feeding mechanism (not shown) and a head carrying mechanism (not shown). The medium feeding mechanism drives a feed roller 51 with the power from a motor (not shown), so as to feed the printing medium P along the Y-axis direction. The head carrying mechanism transmits the power from a motor 53 via a timing belt 55 to the carriage 45, so as to carry the carriage 45 along the X-axis direction. The print head 47 is mounted on the carriage 45. The print head 47 is thus movable in the X-axis direction via the carriage 45 by the head carrying mechanism. The print head 47 is supported on the carriage 45 in the state that the print head 47 faces the printing medium P. The medium feeding mechanism and the head carrying mechanism cause ink to be ejected from the print head 47 while changing the position of the print head 47 relative to the printing medium P, so as to implement printing on the printing medium P.

The following describes some embodiments of the tanks 9. In the description below, for the purpose of discrimination of the tanks 9 of respective embodiments, different alphabets are added in different embodiments as suffixes to the signs as appropriate.

(Embodiment 1)

Figure 5:
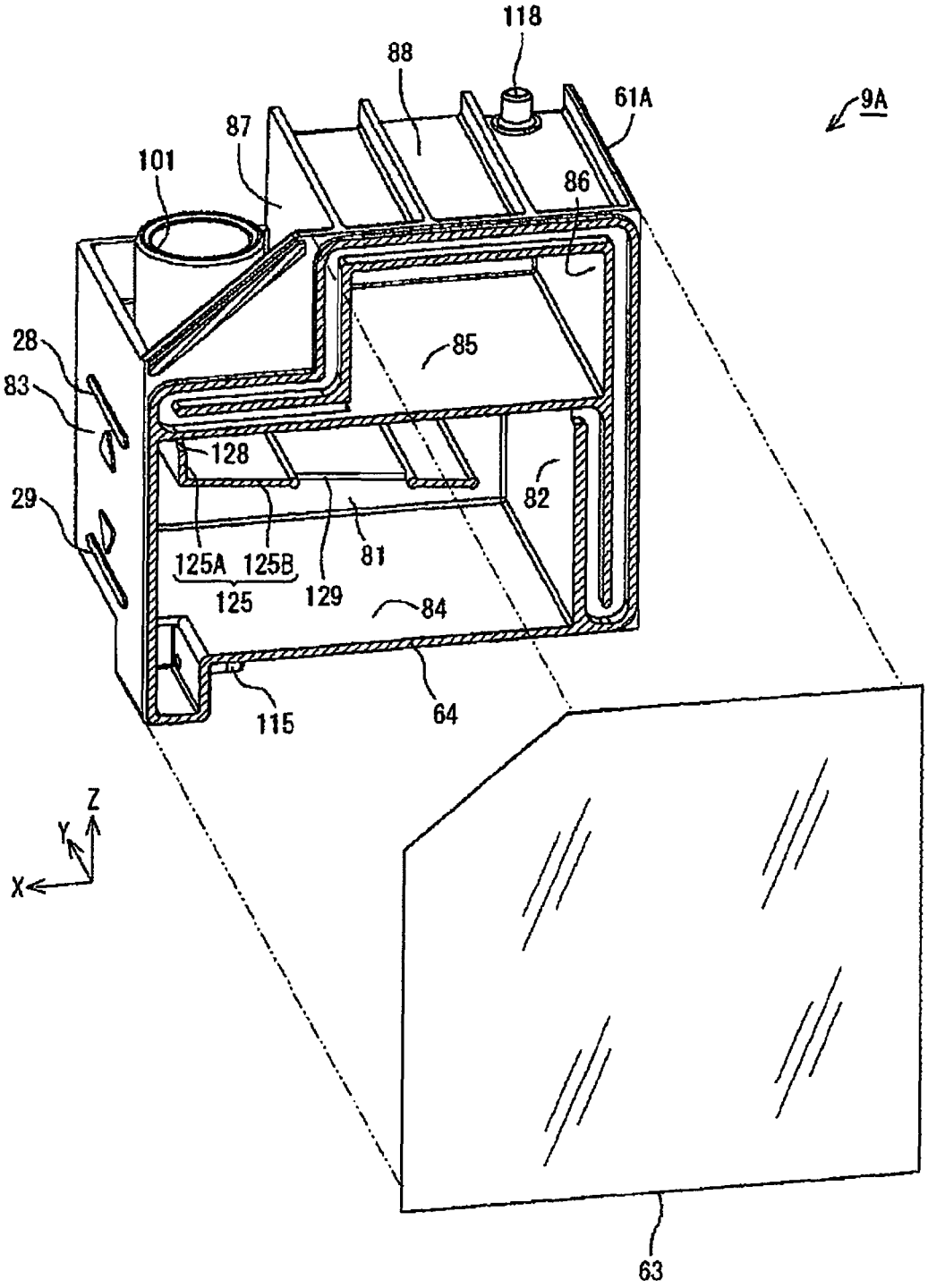
FIG. 5 is an exploded perspective view illustrating a tank of Embodiment 1.

The following describes a tank 9A according to Embodiment 1. As shown in FIG. 5, the tank 9A has a casing 61A as one example of the tank main body and a sheet member 63. The casing 61A is made of a synthetic resin such as nylon or polypropylene. The sheet member 63 is made of a synthetic resin (for example, nylon or polypropylene) in a film-like shape and has flexibility. According to this embodiment, the sheet member 63 has optical transparency. The tank 9A is formed by joining the casing 61A with the sheet member 63. The casing 61A has a joint portion 64. The joint portion 64 is hatched for the clarity of the configuration in FIG. 5. The sheet member 63 is joined with the joint portion 64 of the casing 61A. According to this embodiment, the casing 61A and the sheet member 63 are joined with each other by welding.

Figure 6:
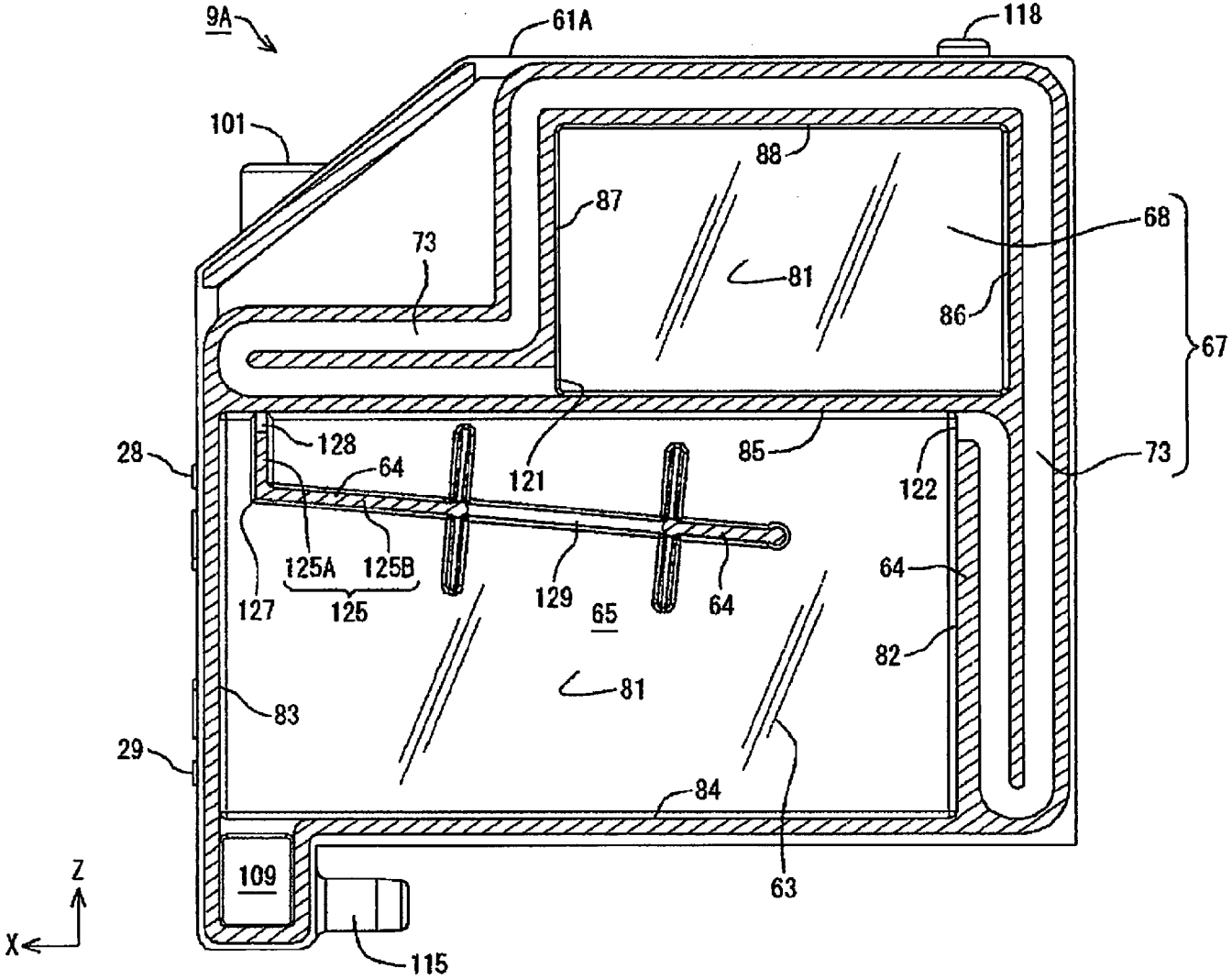
FIG. 6 is a side view of the tank of Embodiment 1 seen from a sheet member side.

As shown in FIG. 6, the tank 9A has a container portion 65 and a communicating portion 67. The communicating portion 67 includes an air chamber 68 and a communicating path 73. In the tank 9A, ink is contained in the container portion 65. In FIG. 6, the tank 9A is seen from the sheet member 63-side, and the casing 61A is illustrated through the sheet member 63. The container portion 65, the air chamber 68 and the communicating path 73 are parted from one another by the joint portion 64. The casing 61A has a first wall 81, a fourth wall 84, a fifth wall 85, a second wall 82, a third wall 83, a sixth wall 86, a seventh wall 87 and an eighth wall 88. The air chamber 68 and part of the communicating path 73 are placed on an opposite side of the fifth wall 85 opposite to the container portion 65-side. In the plan view of the first wall 81 from the sheet member 63-side, the container portion 65 is surrounded by the fourth wall 84, the fifth wall 85, the second wall 82 and the third wall 83. The third wall 83 is arranged to face the window 21 of the second casing 7. In other words, the third wall 83 includes the area having optical transparency in the tank 9A.

Figure 7:
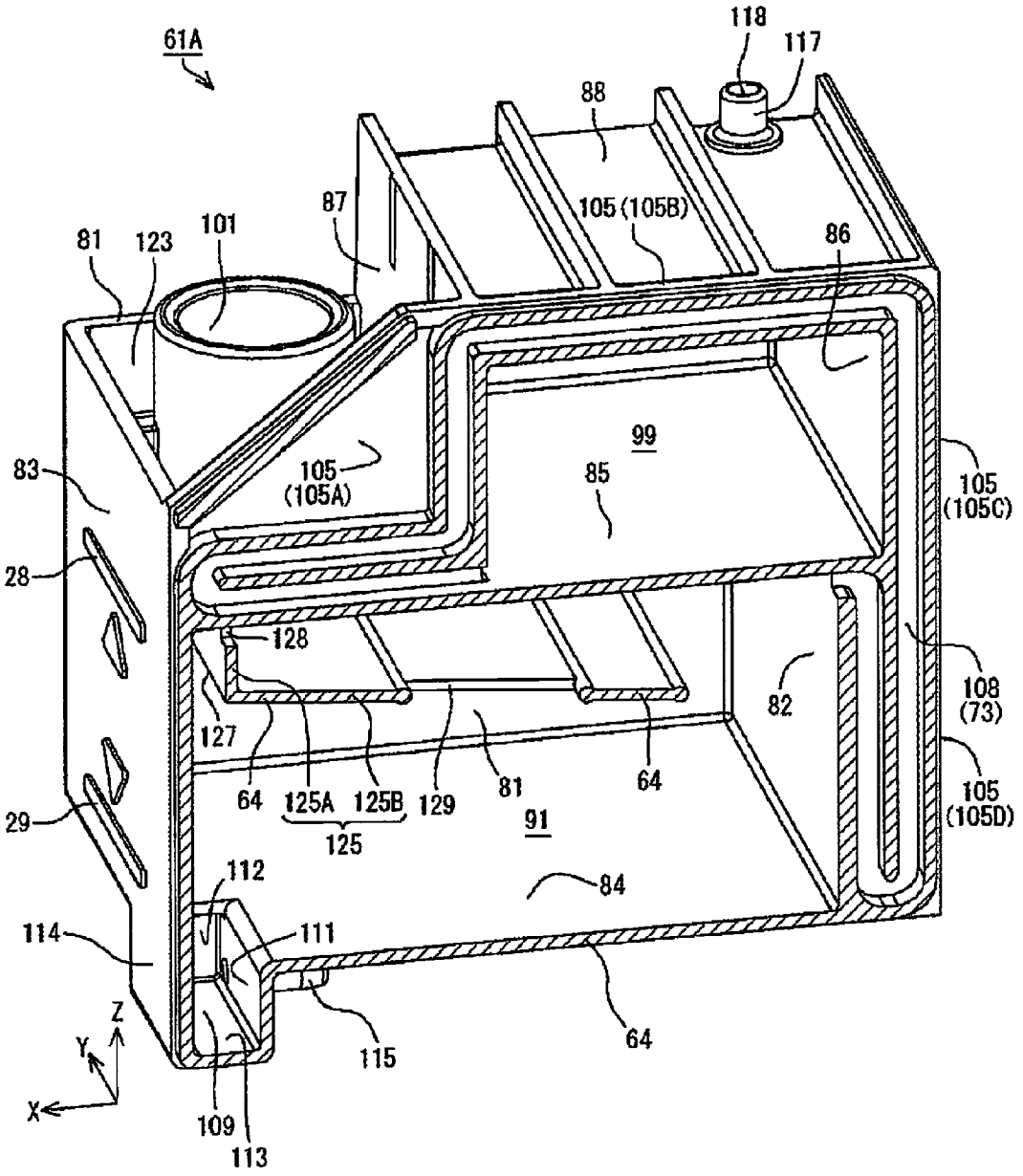
FIG. 7 is a perspective view illustrating a casing of Embodiment 1.

In the plan view of the first wall 81 from the sheet member 63-side, the air chamber 68 is surrounded by the fifth wall 85, the sixth wall 86, the seventh wall 87 and the eighth wall 88. The first wall 81 of the container portion 65 is identical with the first wall 81 of the air chamber 68. In other words, the container portion 65 and the air chamber 68 share the first wall 81 according to this embodiment. The fourth wall 84, the fifth wall 85, the second wall 82 and the third wall 83 respectively intersect with the first wall 81 as shown in FIG. 7. The fifth wall 85 is located on the +Z-axis direction side of the fourth wall 84. The fourth wall 84 and the fifth wall 85 are arranged to face each other across the first wall 81. The third wall 83 is located on the +X-axis direction side of the second wall 82. The second wall 82 and the third wall 83 are arranged to face each other across the first wall 81. The second wall 82 is arranged to intersect with both the fourth wall 84 and the fifth wall 85. The third wall 83 is also arranged to intersect with both the fourth wall 84 and the fifth wall 85.

The fourth wall 84, the fifth wall 85, the second wall 82 and the third wall 83 are protruded in the −Y-axis direction from the first wall 81. A recess 91 is accordingly formed by the first wall 81 as main wall and the fourth wall 84, the fifth wall 85, the second wall 82 and the third wall 83 extended in the −Y-axis direction from the main wall. The recess 91 is formed to be concave in the +Y-axis direction. The recess 91 is open in the −Y-axis direction, i.e., toward the sheet member 63 (shown in FIG. 5). In other words, the recess 91 is provided to be concave in the +Y-axis direction or more specifically to be concave in an opposite direction opposite to the sheet member 63-side (shown in FIG. 5). When the casing 61A is joined with the sheet member 63, the recess 91 is closed by the sheet member 63, so as to form the container portion 65. The first wall 81 to the eighth wall 88 are not limited to flat walls but may have some concavo-convex shapes.

As shown in FIG. 6, the sixth wall 86 is protruded from the fifth wall 85 in an opposite direction of the fifth wall 85 opposite to the fourth wall 84-side, i.e., toward the +Z-axis direction side of the fifth wall 85. The seventh wall 87 is also protruded from the fifth wall 85 in an opposite direction of the fifth wall 85 opposite to the fourth wall 84-side, i.e., toward the +Z-axis direction side of the fifth wall 85. The seventh wall 87 is located on the +X-axis direction side of the sixth wall 86. The sixth wall 86 and the seventh wall 87 are provided at positions facing each other across the air chamber 68. The eighth wall 88 is located on the +Z-axis direction side of the fifth wall 85. The fifth wall 85 and the eighth wall 88 are provided at positions facing each other across the air chamber 68. The sixth wall 86 is arranged to intersect with both the fifth wall 85 and the eighth wall 88. The seventh wall 87 is also arranged to intersect with both the fifth wall 85 and the eighth wall 88.

The sixth wall 86, the seventh wall 87 and the eighth wall 88 are protruded in the −Y-axis direction from the first wall 81. A recess 99 is accordingly formed by the first wall 81 as main wall and the fifth wall 85, the sixth wall 86, the seventh wall 87 and the eighth wall 88 extended in the −Y-axis direction from the main wall. The recess 99 is formed to be concave in the +Y-axis direction. The recess 99 is open in the −Y-axis direction, i.e., toward the sheet member 63 (shown in FIG. 5). In other words, the recess 99 is provided to be concave in the +Y-axis direction or more specifically to be concave in an opposite direction opposite to the sheet member 63-side (shown in FIG. 5). When the casing 61 is joined with the sheet member 63, the recess 99 is closed by the sheet member 63, so as to form the air chamber 68. The amounts of protrusion of the second wall 82 to the eighth wall 88 from the first wall 81 are set to an identical protrusion amount.

The second wall 82 and the sixth wall 86 form a step. The second wall 82 is located on the third wall 83-side of the sixth wall 86, i.e., on the +X-axis direction side of the sixth wall 86. The third wall 83 and the seventh wall 87 also form a step. The seventh wall 87 is located on the second wall 82-side of the third wall 83, i.e., on the −X-axis direction side of the third wall 83. In the plan view of the first wall 81 from the sheet member 63-side, an ink inlet portion 101 is placed between the third wall 83 and the seventh wall 87. The ink inlet portion 101 is provided on the fifth wall 85.

As shown in FIG. 7, the casing 61A has an extended portion 105. The communicating path 73 is provided in the extended portion 105. The extended portion 105 has a region 105A in an area of the fifth wall 85 on the +X-axis direction side of the seventh wall 87 to be extended in the +Z-axis direction from the fifth wall 85 along the periphery of the opening of the recess 91. The region 105A is also provided in the seventh wall 87 to be extended in the +X-axis direction from the seventh wall 87 along the periphery of the opening of the recess 99. The extended portion 105 also has a region 105B extended in the +Z-axis direction from the eighth wall 88. The extended portion 105 also has a region 105C in the sixth wall 86 to be extended in the −X-axis direction from the sixth wall 86 along the periphery of the opening of the recess 99. The extended portion 105 further has a region 105D in the second wall 82 to be extended in the −X-axis direction from the second wall 82 along the periphery of the opening of the recess 91. The communicating path 72 is formed as a groove 108 that is provided in the extended portion 105 to be concave in an opposite direction opposite to the sheet member 63-side (shown in FIG. 5).

As shown in FIG. 7, a recess 109 is provided in the recess 91. The recess 109 is surrounded by a ninth wall 111, a tenth wall 112, an eleventh wall 113 and the third wall 83. The recess 109 is provided to be concave from the fourth wall 84 toward an opposite side of the fourth wall 84 opposite to the fifth wall 85-side, i.e., to be concave in the −Z-axis direction from the fourth wall 84. The ninth wall 111 and the tenth wall 112 are provided on the fourth wall 84 to be protruded from the fourth wall 84 toward the opposite side of the fourth wall 84 opposite to the fifth wall 85-side, i.e., in the −Z-axis direction from the fourth wall 84.

The ninth wall 111 is located between the third wall 83 and the second wall 82 and is arranged to face the third wall 83 across the eleventh wall 113. The tenth wall 112 is located between the first wall 81 and the sheet member 63 (shown in FIG. 5) and is arranged to face the sheet member 63 across the eleventh wall 113. The eleventh wall 113 is located on an opposite side of the fourth wall 84 opposite to the fifth wall 85-side, i.e., on the −Z-axis direction side of the fourth wall 84. The eleventh wall 113 is arranged to face the fifth wall 85. The ninth wall 111 is arranged to intersect with the fourth wall 84, the tenth wall 112 and the eleventh wall 113. The tenth wall 112 is arranged to intersect with the fourth wall 84, the third wall 83 and the eleventh wall 113. The eleventh wall 113 is arranged to intersect with the third wall 83.

Figure 8:
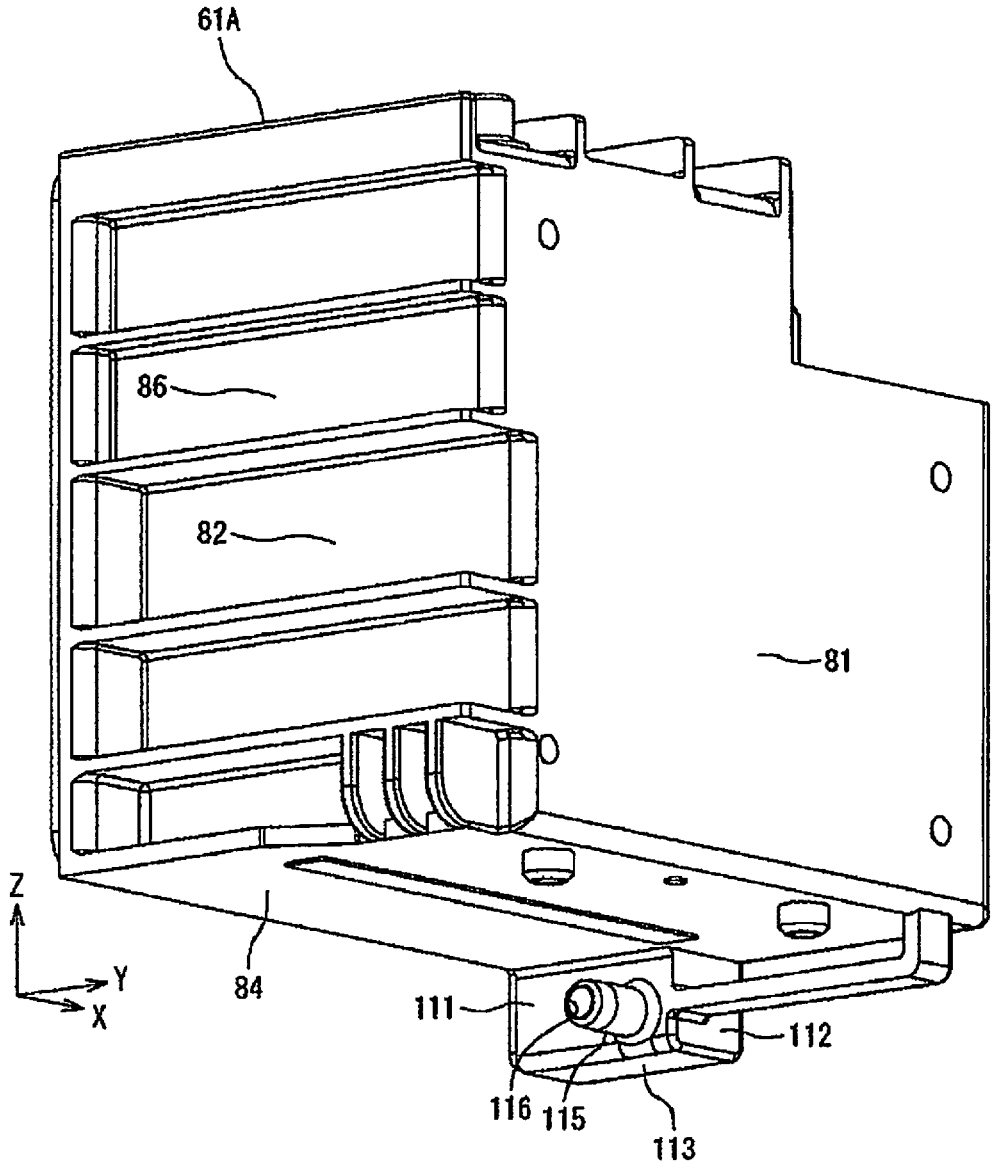
FIG. 8 is a perspective view illustrating the casing of Embodiment 1.

As shown in FIG. 7, the ninth wall 111, the tenth wall 112, the eleventh wall 113 and the third wall 83 surrounding the recess 109 form a supply assembly 114. The supply assembly 114 has a connection structure 115. The connection structure 115 is provided on the ninth wall 111. The connection structure 115 is located on an opposite side of the ninth wall 111 opposite to the recess 109-side. The connection structure 115 is protruded from the ninth wall 111 toward the opposite side of the ninth wall 111 opposite to the recess 109-side, i.e., from the ninth wall 111 toward the second wall 82. As shown in FIG. 8, the connection structure 115 is formed in a cylindrical shape. The connection structure 115 has a supply port 116. The supply port 116 is an opening formed on the connection structure 115 and serves as an outlet of ink from the tank 9A. The supply tube 43 (shown in FIG. 4) is connected with the connection structure 115. The ink contained in the tank 9A is fed from the connection structure 115 through the supply port 116 to the supply tube 43. The ink fed to the supply tube 43 is led through the supply tube 43 to the print head 47.

As shown in FIG. 7, an air communication structure 117 is provided on the eighth wall 88. The air communication structure 117 has an air communication port 118. The air communication port 118 is an opening formed on the air communication structure 117 to be open from the air communication structure 117 outward of the tank 9A. The air communication structure 117 is protruded from the eighth wall 88 toward an opposite side of the eighth wall 88 opposite to the fifth wall 85-side, i.e., on the +Z-axis direction side of the eighth wall 88. In the plan view of the eighth wall 88 or more specifically in the plan view of the eighth wall 88 on an XY plane, the air communication port 118 is provided at a position overlapping the recess 99. The air communication port 118 is arranged to make outside of the casing 61A communicate with inside of the recess 99. The air communication port 118 serves as an air flow path to introduce the air outside of the casing 61A into the inside of the recess 99. In the casing 61A, the joint portion 64 is provided along the outer shapes of the recess 91, the recess 99, the recess 109 and the communicating path 73.

As shown in FIG. 5, the sheet member 63 is arranged to face the first wall 81 across the second wall 82 to the eighth wall 88. In the plan view, the sheet member 63 has dimensions to cover the recess 91, the recess 99, the recess 109 and the extended portion 105 (shown in FIG. 7). The sheet member 63 is welded to the joint portion 64. Accordingly the recess 91, the recess 99, the recess 109 and the communicating path 73 are sealed by the sheet member 63. The sheet member 63 may thus also be regarded as a cover for the casing 61A.

As shown in FIG. 6, the communicating path 73 has a communication port 121 and another communication port 122. The communication port 121 is an opening that is open inward of the air chamber 68. The communication port 122 is an opening that is open inward of the container portion 65. The air chamber 68 communicates with the container portion 65 through the communication port 121, the communicating path 73 and the communication port 122. Accordingly, the container portion 65 communicates with outside of the tank 9A through the communicating path 73, the air chamber 68 and the air communication port 118. In other words, the communicating portion 67 makes the air communication port 118 communicate with the container portion 65. The air flowing from the air communication port 118 into the air chamber 68 is flowed through the communicating path 73 into the container portion 65.

The ink inlet portion 101 is provided on the fifth wall 85. As shown in FIG. 7, the ink inlet portion 101 is located in a recess 131 surrounded by the seventh wall 87, the extended portion 105, the third wall 83 and the first wall 81. As described above, the extended portion 105 is protruded toward the eighth wall 88-side of the fifth wall 85. The seventh wall 87 is also protruded toward the eighth wall 88-side of the fifth wall 85. Similarly, according to this embodiment, the first wall 81 and the third wall 83 are also protruded toward the eighth wall 88-side of the fifth wall 85. The extended portion 105 is arranged to intersect with both the seventh wall 87 and the third wall 83. The first wall 81 is arranged to intersect with both the third wall 83 and the seventh wall 87. Accordingly, an area of the fifth wall 85 on the third wall 83-side of the seventh wall 87 forms the recess 131 surrounded by the seventh wall 87, the extended portion 105, the third wall 83 and the first wall 81. The recess 131 is provided to be concave from the fifth wall 85-side toward the fourth wall 84-side.

The above configuration causes the ink inlet portion 101 to be surrounded by the seventh wall 87, the extended portion 105, the third wall 83 and the first wall 81. In other words, the ink inlet portion 101 is provided in the area of the fifth wall 85 surrounded by the seventh wall 87, the extended portion 105, the third wall 83 and the first wall 81. The recess 131 serves as an ink receiving portion. The ink receiving portion is configured to receive, for example, ink overflowing from the ink inlet portion 101 and ink dripping down in the course of pouring of ink. Accordingly, the recess 131 has the function of ink receiving portion to receive ink.

As shown in FIG. 5, a partition wall 125 is provided in the container portion 65. In the tank 9A, the partition wall 125 may be divided into a first partition wall 125A and a second partition wall 125B. The first partition wall 125A and the second partition wall 125B are continuous with each other via a bent part 127. The first partition wall 125A is located between the third wall 83 and the second wall 82 and is extended along the Z axis. The first partition wall 125A is connected with the fifth wall 85 on an opposite side to the bent part 127-side. The first partition wall 125A is located nearer to the third wall 83 than the second wall 82. The second partition wall 125B is located between the fifth wall 85 and the fourth wall 84 and is extended from the bent part 127 toward the second wall 82. The second partition wall 125B is inclined to be closer to the fourth wall 84 in a direction from the bent part 127-side toward the second wall 82-side.

As shown in FIG. 6, the partition wall 125 is provided on the first wall 81 and is protruded from the first wall 81 toward the sheet member 63 (shown in FIG. 4), i.e., in the −Y-axis direction. The partition wall 125 has a cutout 128 and another cutout 129. The cutout 128 and the cutout 129 are provided on an opposite side of the partition wall 125 opposite to the first wall 81-side, i.e., at an end on the sheet member 63-side (shown in FIG. 4). The cutout 128 and the cutout 129 are formed respectively to be concave from the sheet member 63-side (shown in FIG. 4) toward the first wall 81-side. The cutout 128 is provided on the first partition wall 125A.

The cutout 129 is provided on the second partition wall 125B. As shown in FIG. 5, the cutout 128 provided on the first partition wall 125A is extended from the fifth wall 85-side toward the fourth wall 84-side. The cutout 128 is connected with the fifth wall 85. The cutout 129 is provided between the bent part 127 and an opposite end of the second partition wall 125B opposite to the bent part 127-side. The joint portion 64 is provided in an area of the partition wall 125 between the cutout 128 and the cutout 129. The joint portion 64 is also provided in an area of the partition wall 125 on the second wall 82-side of the cutout 129. The sheet member 63 is also joined with the joint portion 64 of the partition wall 125. When the sheet member 63 is joined with the joint portion 64, clearances are formed at the positions of the cutout 128 and the cutout 129 between the sheet member 63 and the partition wall 125. A clearance is formed at the position of the cutout 128 between the fifth wall 85 and at least part of the partition wall 125. A clearance is formed at the position of the cutout 129 between the sheet member 63 and at least part of the partition wall 125.

Figure 9:
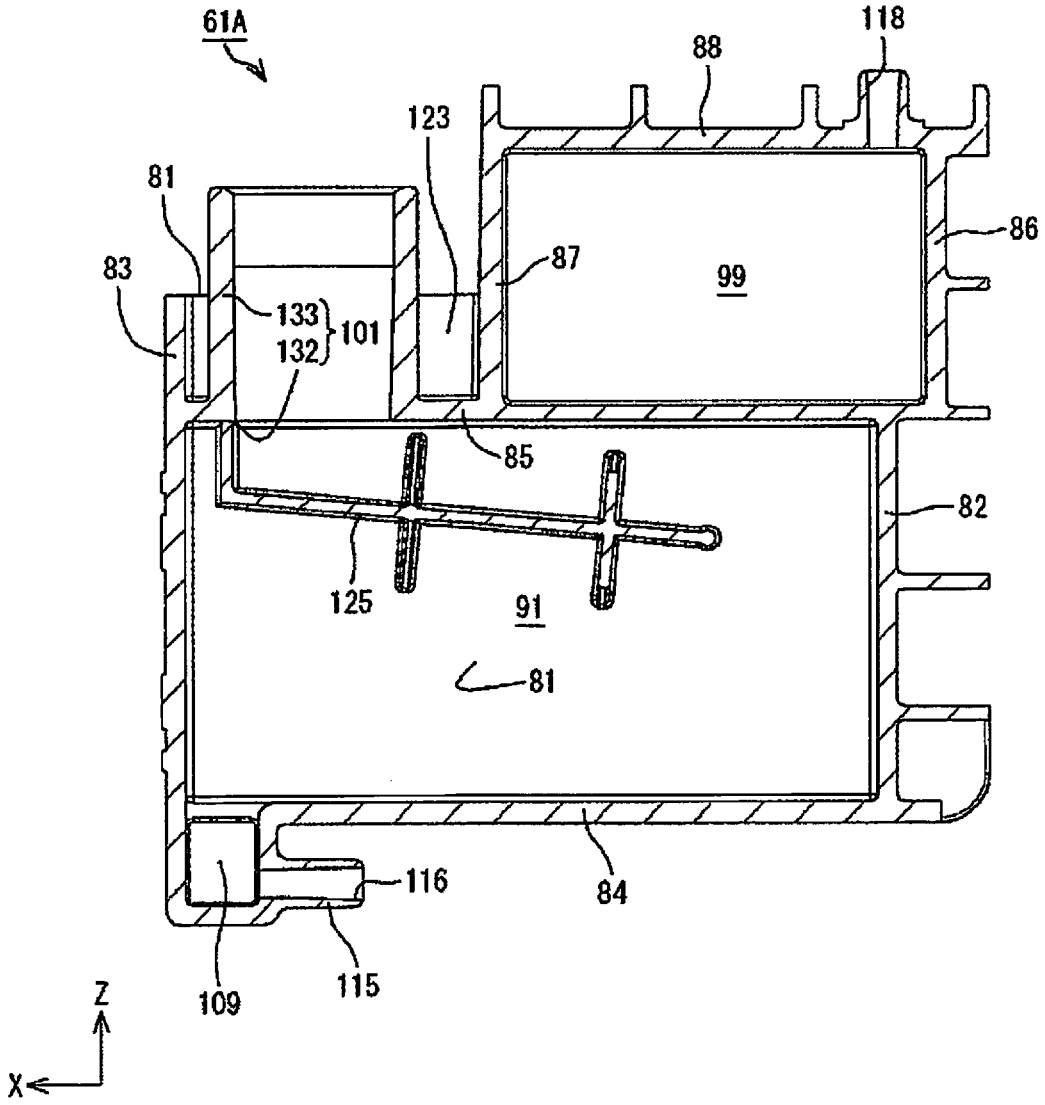
FIG. 9 is a sectional view illustrating an ink inlet portion and an air communication port of the tank of Embodiment 1 taken on an XZ plane.

As shown in FIG. 9 that is a sectional view of the ink inlet portion 101 and the air communication port 118 taken on an XZ plane, the ink inlet portion 101 has an opening 132 and a side wall 133. The opening 132 is a through hole formed in the fifth wall 85. The opening 132 is also an intersecting part at which the ink inlet portion 101 intersects with the container portion 65. The opening 132 intersects with the container portion 65 at the fifth wall 85. The ink inlet portion 101 may alternatively be configured to have the side wall 133 protruded inward of the container portion 65. In this modified configuration that the side wall 133 is protruded inward of the container portion 65, the intersecting part at which the ink inlet portion 101 intersects with the container portion 65 is also defined as the opening 132. The recess 91 communicates with outside of the recess 91 via the opening 132 that is the through hole. The side wall 133 is provided on an opposite side of the fifth wall 85 opposite to the fourth wall 84-side to surround the periphery of the opening 132 and form an ink pouring path. The side wall 133 is protruded from the fifth wall 85 toward the opposite side opposite to the fourth wall 84-side. According to this embodiment, the side wall 133 is protruded from the first wall 81 and the third wall 83 toward the opposite side opposite to the fourth wall 84-side. The side wall 133 serves to prevent the ink accumulated in the recess 131 from flowing into the opening 132.

Figure 10:
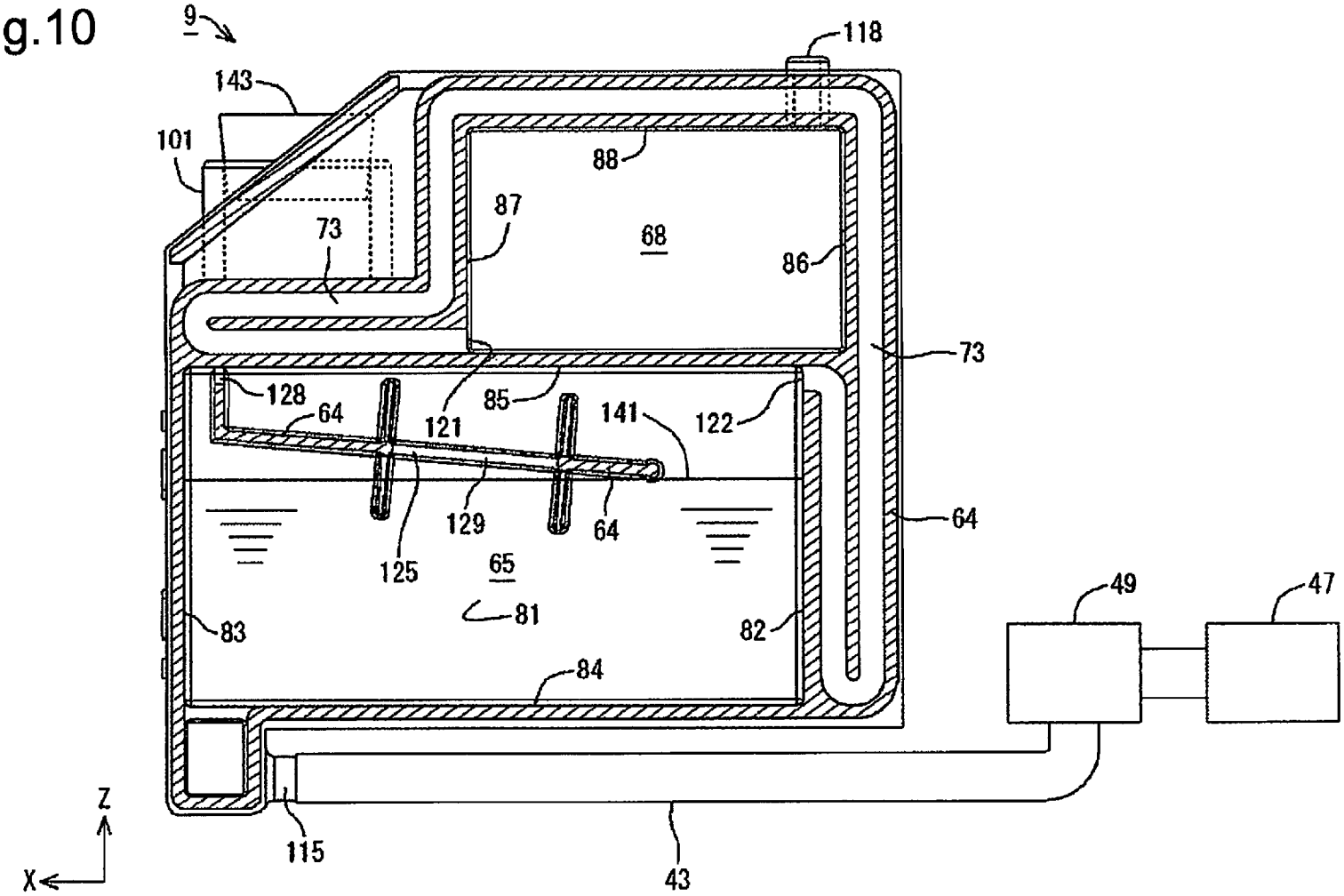
FIG. 10 is a side view of the tank of Embodiment 1 seen from the sheet member side.

In the tank 9A, as shown in FIG. 10 that is a side view of the tank 9A seen from the sheet member 63-side, ink 141 is contained in the container portion 65. For the better understanding of the configuration, the sheet member 63 is omitted from the illustration, and the joint portion 64 is hatched in FIG. 10. The ink 141 contained in the container portion 65 is supplied through the supply port 116 (shown in FIG. 8) formed on the connection structure 115 to the print head 47. According to this embodiment, in the use state of the liquid ejection system 1 for printing, the supply tube 43 is connected with the supply port 116, and the ink inlet portion 101 is closed by a cap 143. The ink 141 contained in the container portion 65 is flowed through the supply port 116 to reach the print head 47 by suction of the supply tube 43 via the relay unit 49.

With progress in printing by means of the print head 47, the ink 141 contained in the container portion 65 is fed toward the print head 47. Accordingly, the internal pressure of the container portion 65 decreases to be lower than the atmospheric pressure with progress in printing by means of the print head 47. As the internal pressure of the container portion 65 becomes lower than the atmospheric pressure, the air in the air chamber 68 flows through the communicating path 73 into the container portion 65. This is likely to maintain the internal pressure of the container portion 65 at the atmospheric pressure. The above configuration causes the ink 141 contained in the tank 9 to be supplied to the print head 47. When the remaining amount of the ink 141 is decreased with consumption of the ink 141 contained in the container portion 65 of the tank 9, the operator is allowed to refill the container portion 65 with ink newly supplied from the ink inlet portion 101.

As described above, the partition wall 125 is provided in the container portion 65. Accordingly, the ink poured from the ink inlet portion 101 into the container portion 65 is guided by the partition wall 125 in a direction to be away from the third wall 83, i.e., in a direction from the third wall 83-side toward the second wall 82-side. This makes the ink poured from the ink inlet portion 101 into the container portion 65 unlikely to be directly poured on the third wall 83. This accordingly maintains the high optical transparency of the third wall 83 during pouring of ink from the ink inlet portion 101 into the container portion 65. As a result, this enables the liquid level of ink contained in the container portion 65 to be accurately reflected on the third wall 83 when ink is poured from the ink inlet portion 101 into the container portion 65. Accordingly this enables the liquid level of ink contained in the container portion 65 to be accurately recognized when ink is poured from the ink inlet portion 101 into the container portion 65.

The first partition wall 125A of the partition wall 125 is located on the third wall 83-side of the opening 132 that is the intersecting part of the ink inlet portion 101 and the fifth wall 85 as shown in FIG. 9. Accordingly, at least part of the partition wall 125 is located between the third wall 83 and the opening 132 that is the intersecting part of the ink inlet portion 101 and the fifth wall 85. When ink is poured from the ink inlet portion 101 into the container portion 65, the partition wall 125 interferes with the flow of the ink from the ink inlet portion 101 toward the third wall 83. Even when ink is splashed from the ink inlet portion 101 toward the third wall 83, this configuration reduces the likelihood that ink adheres to the third wall 83. This accordingly maintains the high optical transparency of the third wall 83 during pouring of ink from the ink inlet portion 101 into the container portion 65. As a result, this enables the liquid level of ink contained in the container portion 65 to be accurately reflected on the third wall 83 when ink is poured from the ink inlet portion 101 into the container portion 65. Accordingly this enables the liquid level of ink contained in the container portion 65 to be accurately recognized when ink is poured from the ink inlet portion 101 into the container portion 65.

In Embodiment 1, the container portion 65 corresponds to the liquid container portion; the ink inlet portion 101 corresponds to the liquid inlet portion, the fifth wall 85 corresponds to the first wall portion; the third wall 83 corresponds to the second wall portion; the fourth wall 84 corresponds to the bottom wall; the first wall 81 corresponds to the third wall portion; and the sheet member 63 corresponds to the fourth wall portion.

In the tank 9A, a clearance is formed at the position of the cutout 128 between the fifth wall 85 and at least part of the partition wall 125. This configuration makes the air trapped in a space surrounded by the fifth wall 85, the third wall 83, the first wall 81 and the sheet member 63 likely to be released through the clearance between the fifth wall 85 and at least part of the partition wall 125 during pouring of ink from the ink inlet portion 101 into the container portion 65. Accordingly, the liquid level of ink in the space surrounded by the fifth wall 85, the third wall 83, the first wall 81 and the sheet member 63 is likely to adequately rise during pouring of ink from the ink inlet portion 101 into the container portion 65. This configuration enables the liquid level of ink contained in the container portion 65 to be accurately recognized during pouring of ink from the ink inlet portion 101 into the container portion 65. As a result, this enables the amount of ink contained in the container portion 65 to be accurately recognized.

In the tank 9A, a clearance is formed at the position of the cutout 129 between the sheet member 63 and at least part of the partition wall 125. This configuration makes the air trapped in the space surrounded by the fifth wall 85, the third wall 83, the first wall 81 and the sheet member 63 likely to be released through the clearance between the sheet member 63 and at least part of the partition wall 125 during pouring of ink from the ink inlet portion 101 into the container portion 65. Accordingly, the liquid level of ink in the space surrounded by the fifth wall 85, the third wall 83, the first wall 81 and the sheet member 63 is likely to adequately rise during pouring of ink from the ink inlet portion 101 into the container portion 65. This configuration enables the liquid level of ink contained in the container portion 65 to be accurately recognized during pouring of ink from the ink inlet portion 101 into the container portion 65. As a result, this enables the amount of ink contained in the container portion 65 to be accurately recognized.

In the tank 9A, as shown in FIG. 9, the distance between one end of the partition wall 125 on the fifth wall 85-side and the third wall 83 is smaller than the distance between the other end of the partition wall 125 on the opposite side to the fifth wall 85-side and the third wall 83. Accordingly, the partition wall 125 is arranged to be away from the third wall 83 in a direction from one end on the fifth wall 85-side toward the other end. This makes the ink poured from the ink inlet portion 101 into the container portion 65 likely to be away from the third wall 83. As a result, this makes the ink poured from the ink inlet portion 101 into the container portion 65 unlikely to be directly poured on the third wall 83.

In the tank 9A, as shown in FIG. 9, the second partition wall 125B of the partition wall 125 is located vertically below the opening 132 that is the intersecting part of the ink inlet portion 101 and the fifth wall 85. In other words, in the plan view of the opening 132 in the −Z-axis direction, at least part of the second partition wall 125B overlaps the opening 132. When the ink poured from the ink inlet portion 101 into the container portion 65 drips down in the vertical direction from the opening 132, the partition wall 125 reduces the impact of ink dripping and thereby reduces splash of the dripping ink. This is likely to suppress the dripping ink from being splashed and adhere to the third wall 83. As a result, this configuration enables the liquid level of ink contained in the container portion 65 to be accurately reflected on the third wall 83 during pouring of ink from the ink inlet portion 101 into the container portion 65. Accordingly this enables the liquid level of ink contained in the container portion 65 to be accurately recognized when ink is poured from the ink inlet portion 101 into the container portion 65.

The positions at which the cutout 128 and the cutout 129 are formed are not limited to the end on the sheet member 63-side. The cutout 128 and the cutout 129 may be provided on the first wall 81-side. The cutout 128 may be provided at any position that enables the air trapped between the third wall 83 and the partition wall 125 to be moved to the ink inlet portion 101 via the cutout 128 during pouring of ink from the ink inlet portion 101.

The partition wall 125 is not limited to the configuration that is divided into the first partition wall 125A and the second partition wall 125B but may have any configuration that allows the partition wall 125 to interfere with the flow of ink from the ink inlet portion 101 toward the third wall 83 when ink is poured from the ink inlet portion 101 into the container portion 65. The partition wall 125 may be configured, for example, to have only the first partition wall 125A.

(Embodiment 2)

Figure 11:
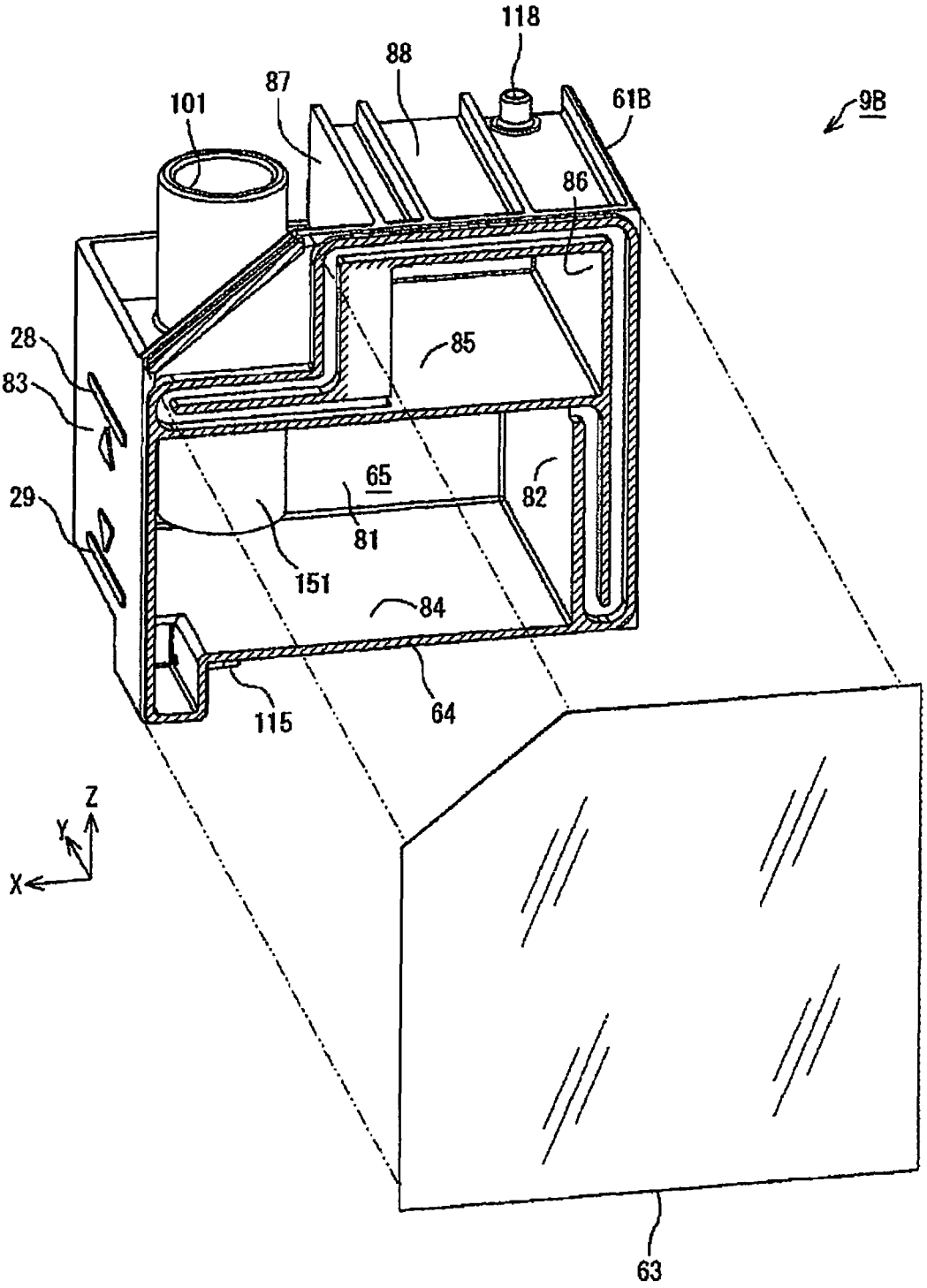
FIG. 11 is an exploded perspective view illustrating a tank of Embodiment 2.

The following describes a tank 9B according to Embodiment 2. The tank 9B has a similar configuration to that of the tank 9A of Embodiment 1, except the partition wall 125 of the tank 9A of Embodiment 1. The like components of the tank 9B to those of the tank 9A are expressed by the like signs to those of Embodiment 1 and are not specifically described here. As shown in FIG. 11, the tank 9B has a casing 61B as one example of the tank main body and a sheet member 63. The casing 61B is made of a synthetic resin such as nylon or polypropylene. The sheet member 63 is identical with that of Embodiment 1 and is not specifically described here.

Figure 12:
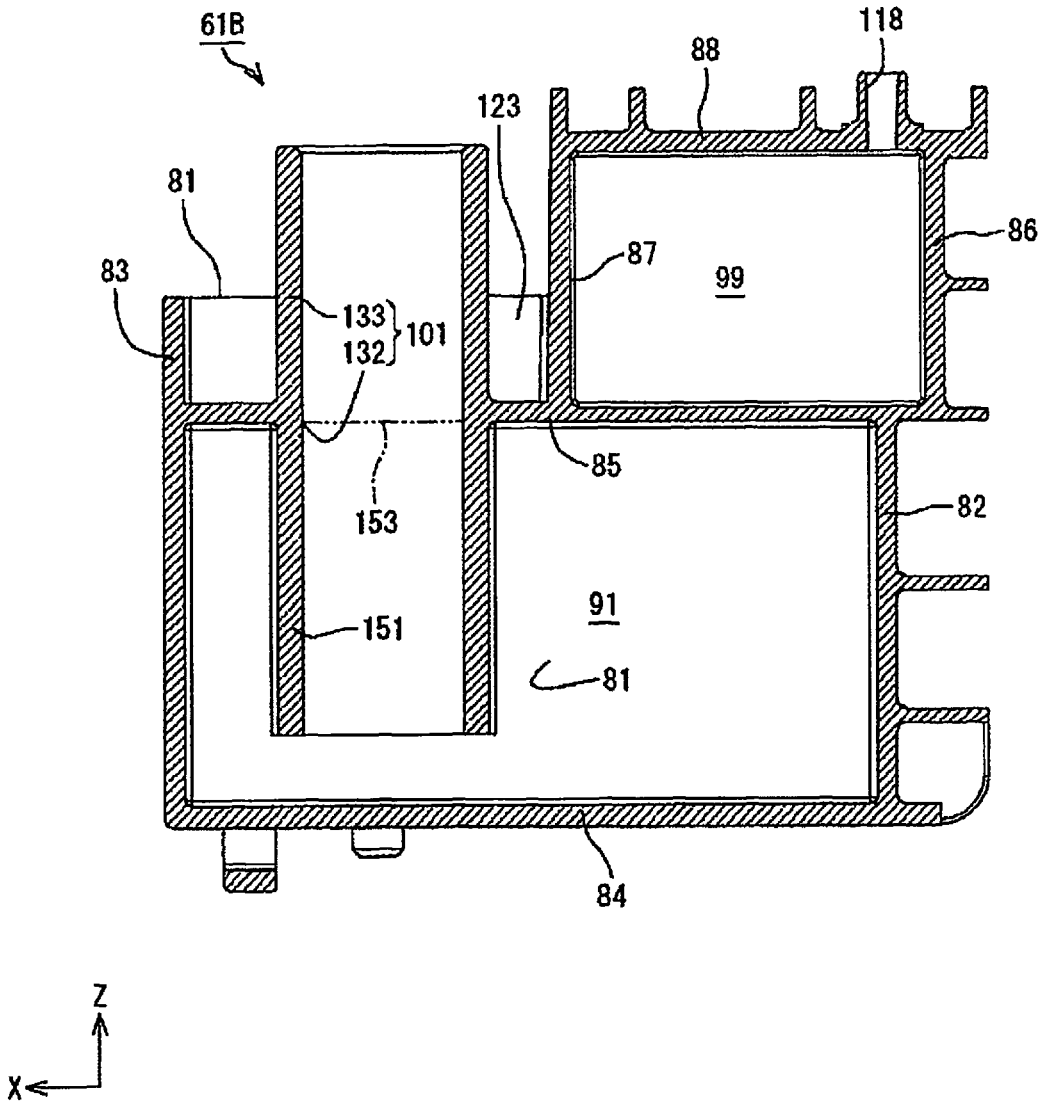
FIG. 12 is a sectional view illustrating an ink inlet portion and an air communication port of the tank of Embodiment 2 taken on the XZ plane.

The casing 61B is provided with a partition wall 151 placed in the container portion 65. The partition wall 151 is continuous with the ink inlet portion 101 and is formed in a cylindrical shape. As shown in FIG. 12 that is a sectional view of the ink inlet portion and the air communication port taken on the XZ plane, the partition wall 151 is extended along the Z axis from an intersecting part 153 at which the ink inlet portion 101 intersects with the container portion 65. The cylindrical partition wall 151 is connected with the fifth wall 85 and is extended from the fifth wall 85 toward the fourth wall 84. The cylindrical partition wall 151 is arranged to surround the opening 132 of the ink inlet portion 101. The intersecting par 153 is also defined as the opening 132 provided in the fifth wall 85.

The tank 9B employs the configuration that the side wall 133 is continuous with the partition wall 151. The configuration of the partition wall 151 is, however, not limited to this configuration. For example, the partition wall 151 may be configured to surround the opening 132 from the outer side of the opening 132. In this modified configuration, a step is formed between the side wall 133 and the partition wall 151.

In the tank 9A of Embodiment 2, the cylindrical partition wall 151 is likely to suppress the splash of ink from the ink inlet portion 101 toward the third wall 83 when ink is poured from the ink inlet portion 101 into the container portion 65. This reduces the likelihood that ink adheres to the third wall 83. This accordingly maintains the high optical transparency of the third wall 83 during pouring of ink from the ink inlet portion 101 into the container portion 65. As a result, this enables the liquid level of ink contained in the container portion 65 to be accurately reflected on the third wall 83 when ink is poured from the ink inlet portion 101 into the container portion 65. Accordingly this enables the liquid level of ink contained in the container portion 65 to be accurately recognized when ink is poured from the ink inlet portion 101 into the container portion 65.

In Embodiment 2, the container portion 65 corresponds to the liquid container portion; the ink inlet portion 101 corresponds to the liquid inlet portion, the fifth wall 85 corresponds to the first wall portion; the third wall 83 corresponds to the second wall portion; the fourth wall 84 corresponds to the bottom wall; the first wall 81 corresponds to the third wall portion; and the sheet member 63 corresponds to the fourth wall portion. In the first aspect, the tank unit 5 corresponds to the liquid container unit.

In Embodiment 1 and Embodiment 2 described above, the third wall 83 inside of the container portion 65 may be configured to have enhanced liquid repellency against ink. The third wall 83 of this configuration is likely to repel the ink even in the case that the splashed ink adheres to the third wall 83 during pouring of ink from the ink inlet portion 101 into the container portion 65. This accordingly maintains the higher optical transparency of the third wall 83 during pouring of ink from the ink inlet portion 101 into the container portion 65. As a result, this enables the liquid level of ink contained in the container portion 65 to be more accurately reflected on the third wall 83 when ink is poured from the ink inlet portion 101 into the container portion 65. Accordingly this enables the liquid level of ink contained in the container portion 65 to be more accurately recognized when ink is poured from the ink inlet portion 101 into the container portion 65.

One method employed to achieve the configuration of enhancing the liquid repellency against ink may be, for example, that the casing 61A or the casing 61B is made of a material having liquid repellency against ink. Another method employed to achieve the configuration of enhancing the liquid repellency against ink may be, for example, that a material having liquid repellency against ink (hereinafter called liquid repellent material) is applied on the third wall 83 inside of the container portion 65. An example of the liquid repellent material may be a paint containing a fluororesin or a fluorine compound. The area in which the liquid repellent material is applied may be the entire area of the third wall 83 or part of the third wall 83.

Figure 13:
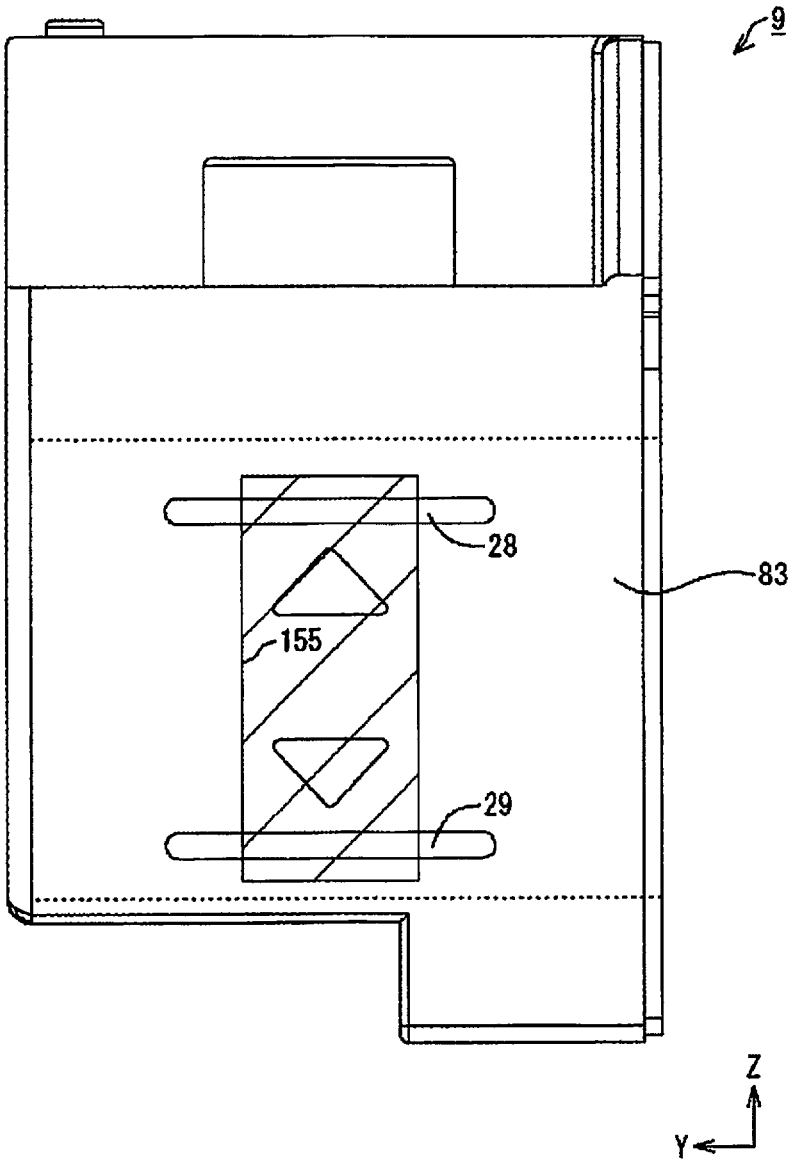
FIG. 13 is a diagram illustrating a third wall of the tanks of Embodiment 1 and Embodiment 2.

A method employed to apply the liquid repellent material on only part of the third wall 83 may apply the liquid repellent material on a partial area 155 in the width of the third wall 83 along the Y axis as shown in FIG. 13. In this configuration, for example, applying the liquid repellent material between the upper limit mark 28 and the lower limit mark 29 enhances the visibility of the liquid level of ink from the upper limit to the lower limit of the amount of ink. This method is not limited to the configuration that only one area 155 is provided on the third wall 83 but may employ a configuration that a plurality of areas 155 are arrayed along the Y axis on the third wall 83.

Figure 14:
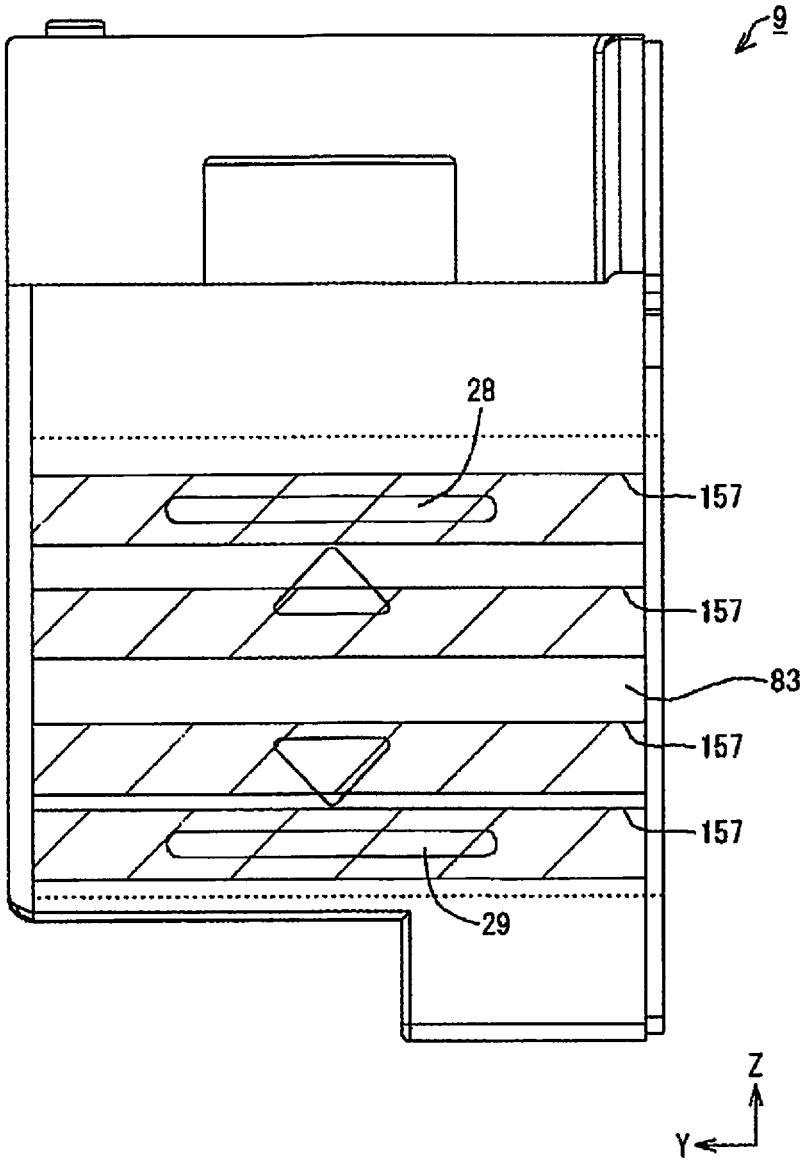
FIG. 14 is a diagram illustrating the third wall of the tanks of Embodiment 1 and Embodiment 2.

Another method employed to apply the liquid repellent material on only part of the third wall 83 may apply the liquid repellent material on partial areas 157 in the height of the third wall 83 along the Z axis as shown in FIG. 14. In the illustrated example of FIG. 14, a plurality of areas 157 are arrayed along the Z axis. The intervals of the plurality of areas 157 arrayed along the Z axis may be equal or may be different.

Figure 15:
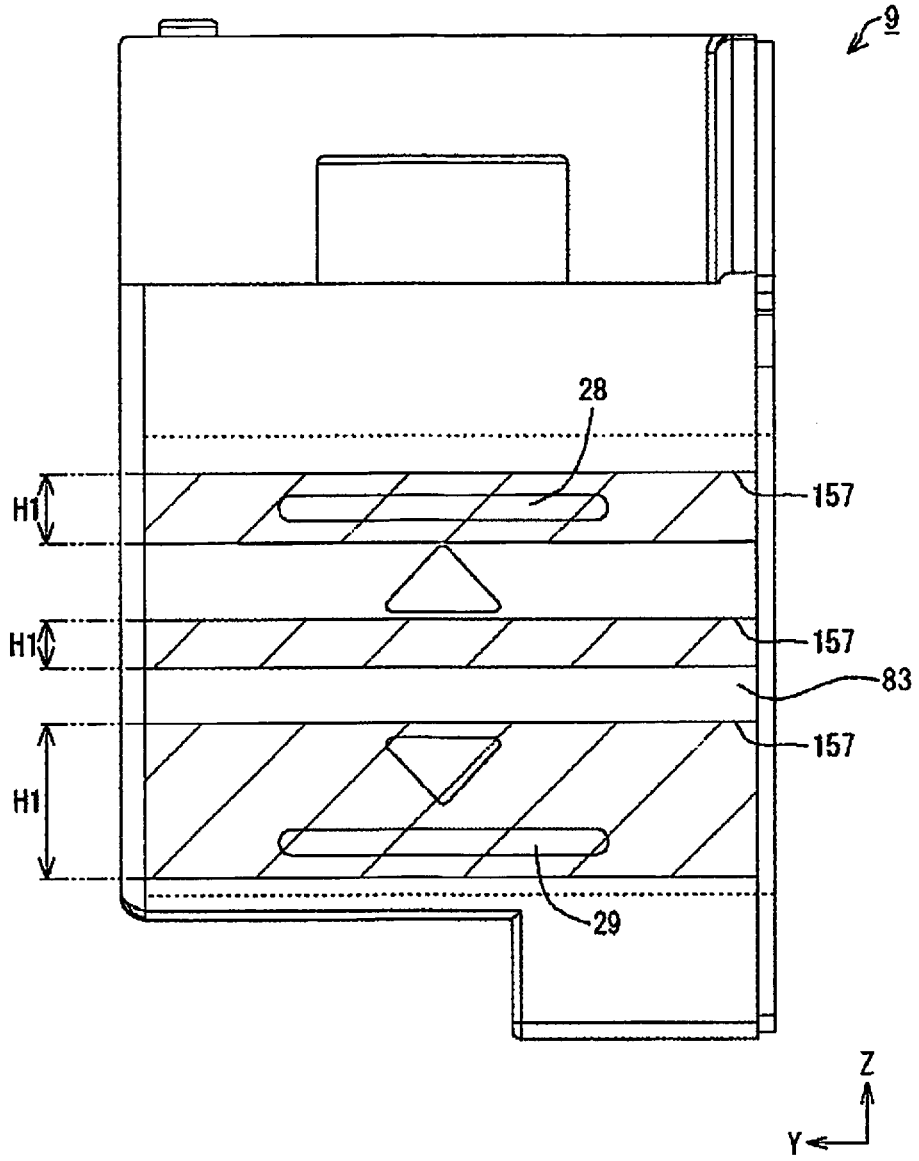
FIG. 15 is a diagram illustrating the third wall of the tanks of Embodiment 1 and Embodiment 2.

In the configuration that the liquid repellent material is applied on only the partial areas 157 in the height of the third wall 83 along the Z axis, the plurality of areas 157 may have equal height dimensions H1 or may have different height dimensions H1 along the Z axis as shown in FIG. 15. In the illustrated example of FIG. 15, the plurality of areas 157 have different height dimensions H1.

Figure 16:
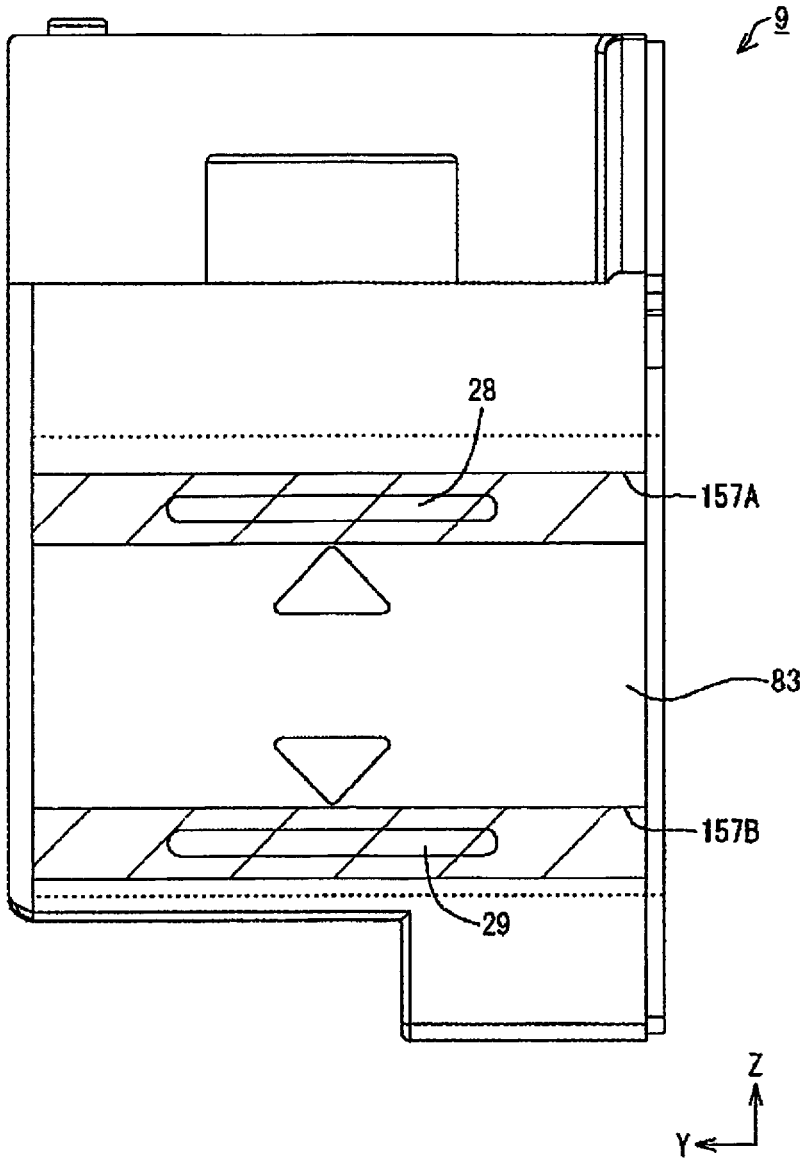
FIG. 16 is a diagram illustrating the third wall of the tanks of Embodiment 1 and Embodiment 2.

In the configuration that the liquid repellent material is applied on only the partial areas 157 in the height of the third wall 83 along the Z axis, the liquid repellent material may be applied on an area 157A including the upper limit mark 28 and an area 157B including the lower limit mark 29 as shown in FIG. 16. This configuration facilitates at least the upper limit and the lower limit of the amount of ink to be accurately recognized.

(Second Aspect)

In the first aspect, the plurality of tanks 9 are not placed inside of the first casing 6 arrange to cover the mechanism unit 10. In other words, the first aspect employs the configuration that the plurality of tanks 9 are placed outside of the first casing 6. According to another configuration, the plurality of tanks 9 may be placed inside of the first casing 6. The following describes a multifunction printer as one example of the liquid ejection system according to a second aspect, with regard to the configuration that the plurality of tanks 9 are placed inside of a casing.

Figure 17:
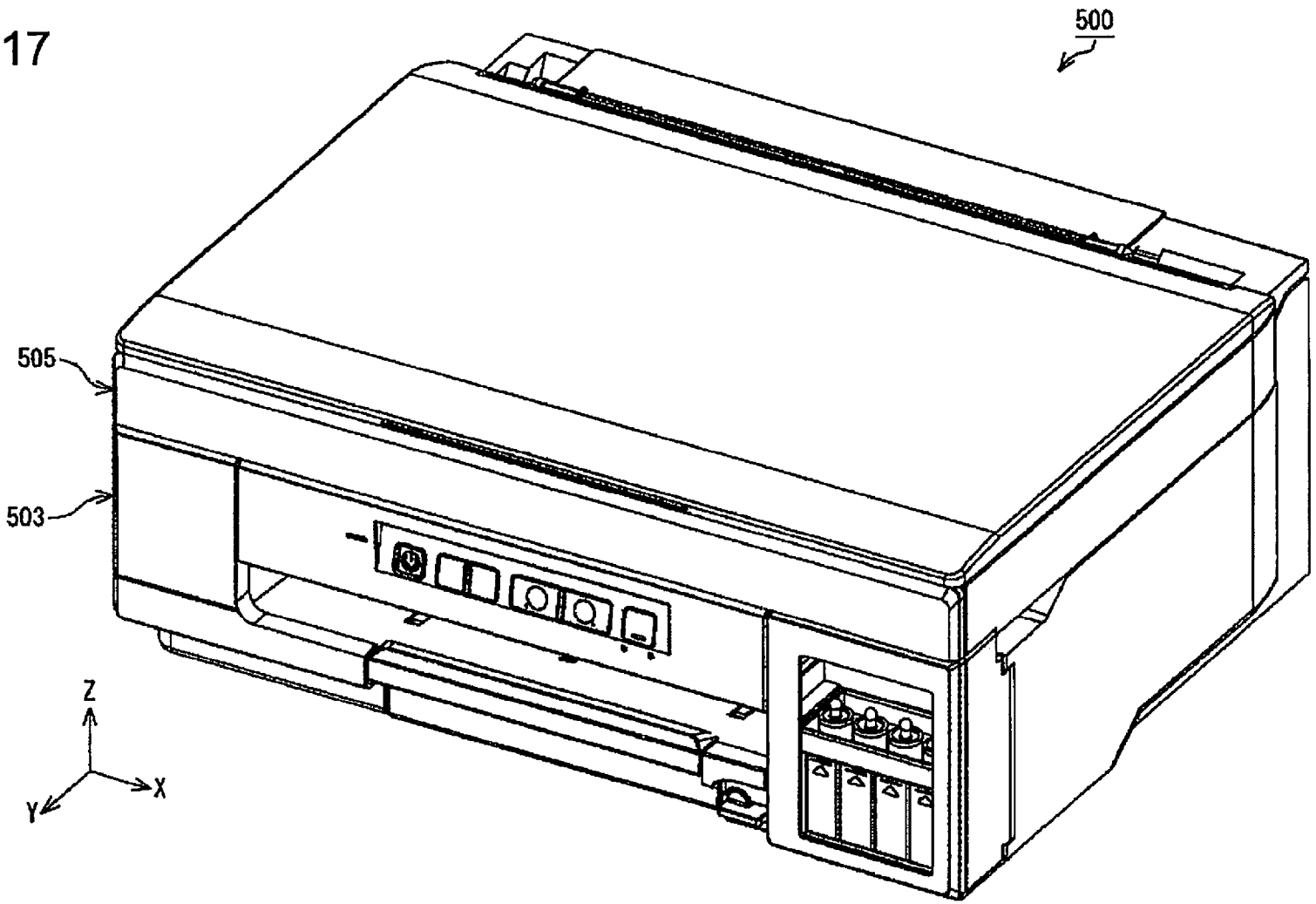
FIG. 17 is a perspective view illustrating a multifunction printer according to a second aspect.

A multifunction printer 500 of this aspect includes a printer 503 and a scanner unit 505 as shown in FIG. 17. In the multifunction printer 500, the printer 503 and the scanner unit 505 are stacked. In the use state of the printer 503, the scanner unit 505 is placed vertically above the printer 503. XYZ axes as coordinate axes that are orthogonal to one another are shown in FIG. 17. The XYZ axes are also added as appropriate in subsequent drawings. The XYZ axes in FIG. 17 and the XYZ axes in the subsequent drawings are equivalent to the XYZ axis shown in FIG. 1. The like components of the multifunction printer 500 to those of the liquid ejection system 1 or the liquid ejection system 100 are expressed by the like signs to those of the liquid ejection system 1 or the liquid ejection system 100 and are not specifically described here.

Figure 18:
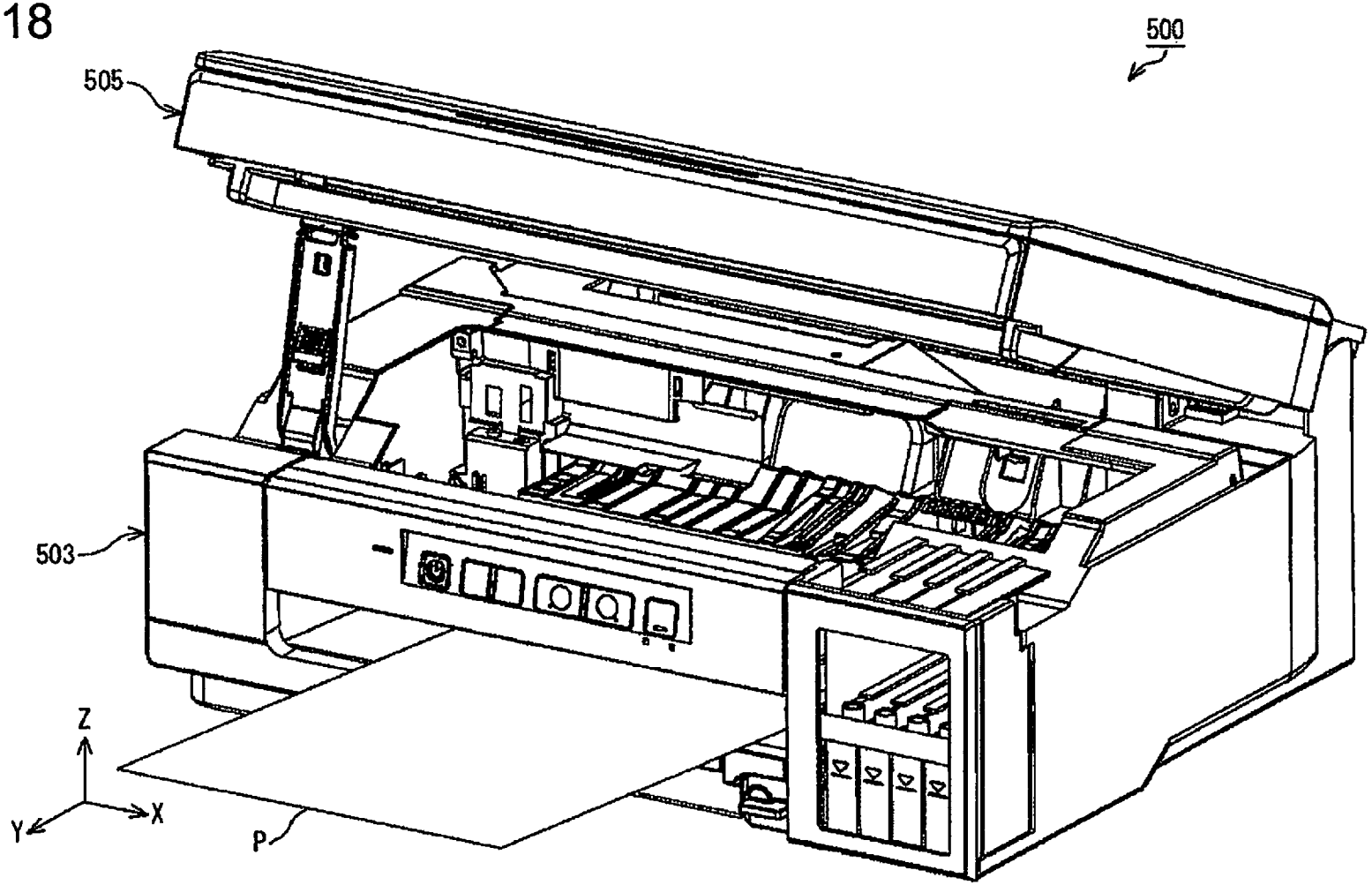
FIG. 18 is a perspective view illustrating the multifunction printer of the second aspect.

The scanner unit 505 is flatbed type having an imaging element (not shown) such as an image sensor, a platen and a cover. The scanner unit 505 is capable of reading an image or the like recorded on a medium such as paper via the imaging element in the form of image data. The scanner unit 505 accordingly serves as a reader of the image or the like. As shown in FIG. 18, the scanner unit 505 is provided to be rotatable relative to a casing 507 of the printer 503. A printer 503-side surface of the platen of the scanner unit 505 also serves as a cover of the printer 503 to cover the casing 507 of the printer 503.

Figure 19:
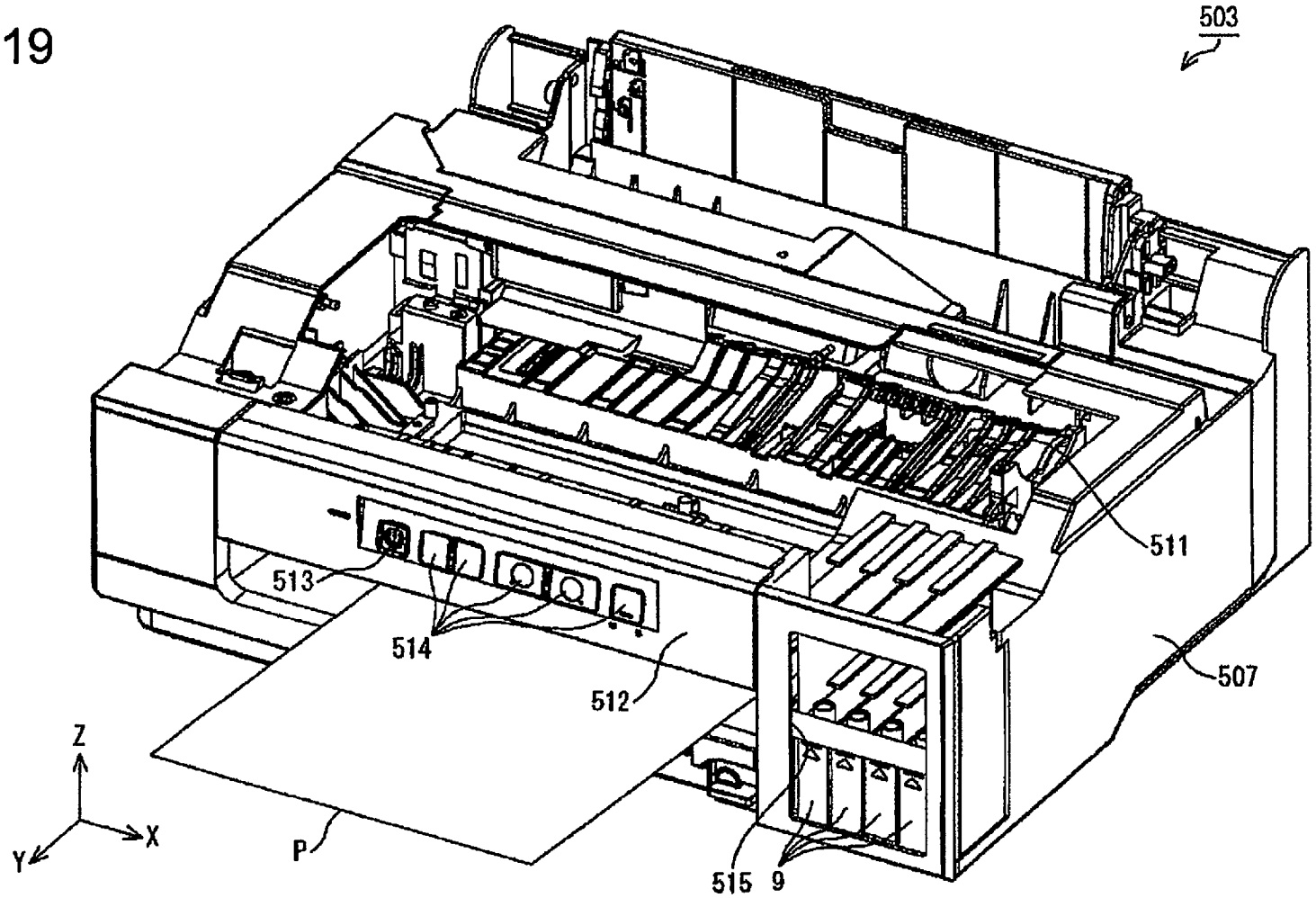
FIG. 19 is a perspective view illustrating a printer according to the second aspect.

The printer 503 performs printing on a printing medium P such as printing paper with ink as one example of liquid. As shown in FIG. 19, the printer 503 includes the casing 507 and a plurality of tanks 9 as one example of the liquid container. The casing 507 is an integrally molded component that forms an outer shell of the printer 503 and includes a mechanism unit 511 of the printer 503. The plurality of tanks 9 are placed inside of the casing 507 to respectively contain inks used for printing. More specifically, the printer 503 has four tanks 9. The four tanks 9 respectively contain different inks. The printer 503 employs four different inks, i.e., black, yellow, magenta and cyan. Each of the four tanks 9 is provided to contain a different ink.

The printer 503 also has an operation panel 512. The operation panel 512 is provided with a power button 513 and other operation buttons 514. The operator who operates the printer 503 faces the operation panel 512 to operate the power button 513 and the operation buttons 514. A front surface of the printer 503 is a surface where the operation panel 512 is provided. The casing 507 has a window 515 provided on the front surface of the printer 503. The window 515 has optical transparency. The four tanks 9 described above are placed at a position overlapping the window 515. This configuration enables the operator to visually check the four tanks 9 through the window 515.

In the printer 503, a region of each of the tank 9 facing the window 515 has optical transparency. Ink contained in the tank 9 is visible through the region of each tank 9 having optical transparency. This enables the operator to observe the four tanks 9 through the window 515 and thereby visually check the amounts of inks contained in the respective tanks 9. In the printer 503, the window 515 is provided on the front surface of the printer 503. This configuration enables the operator facing the operation panel 512 to visually recognize the respective tanks 9 through the window 515. This accordingly enables the operator to check the remaining amounts of inks in the respective tanks 9 while operating the printer 503.

Figure 20:
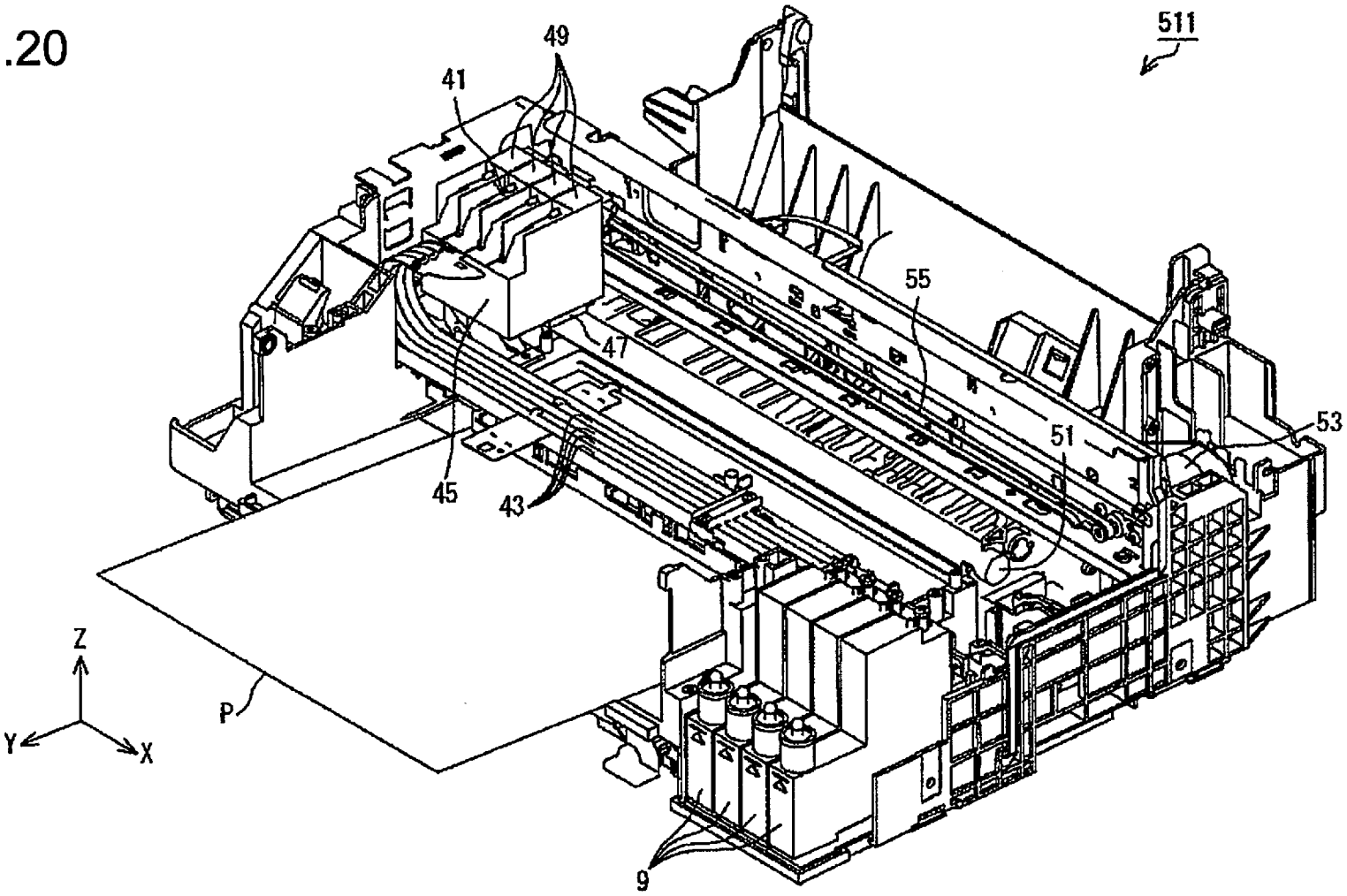
FIG. 20 is a perspective view illustrating a mechanism unit of the printer of the second aspect.

As shown in FIG. 20 that is a perspective view illustrating the mechanism unit 511, the printer 503 includes a printing assembly 41 and supply tubes 43. The printing assembly 41 and the supply tubes 43 have the similar configurations to those of the printing assembly 41 and the supply tubes 43 in the liquid ejection system 1 or in the liquid ejection system 100. Like the liquid ejection system 1 or the liquid ejection system 100, in the printer 503, the medium feeding mechanism drives a feed roller 51 with the power from a motor (not shown), so as to feed the printing medium P along the Y-axis direction. Like the liquid ejection system 1 or the liquid ejection system 100, in the printer 503, the head carrying mechanism transmits the power from a motor 53 via a timing belt 55 to a carriage 45, so as to carry the carriage 45 along the X-axis direction. The print head 47 is mounted on the carriage 45. The print head 47 is thus movable in the X-axis direction via the carriage 45 by the head carrying mechanism. The medium feeding mechanism and the head carrying mechanism cause ink to be ejected from the print head 47 while changing the position of the print head 47 relative to the printing medium P, so as to implement printing on the printing medium P.

In the respective aspects and embodiments described above, the liquid ejection apparatus may be a liquid ejection apparatus that sprays, ejects or applies and thereby consumes a liquid other than ink. The liquid ejected in the form of very small amounts of droplets from the liquid ejection apparatus may be in a granular shape, a teardrop shape or a tapered threadlike shape. The liquid herein may be any material consumed in the liquid ejection apparatus. The liquid may be any material in the liquid phase and may include liquid-state materials of high viscosity or low viscosity, sols, aqueous gels and other liquid-state materials including inorganic solvents, organic solvents, solutions, liquid resins and liquid metals (metal melts). The liquid is not limited to the liquid state as one of the three states of matter but includes solutions, dispersions and mixtures of the functional solid material particles, such as pigment particles or metal particles, solved in, dispersed in or mixed with a solvent. Typical examples of the liquid include liquid crystal, in addition to ink described in the above aspects and embodiments. The ink herein includes general water-based inks and oil-based inks, as well as various liquid compositions, such as gel inks and hot-melt inks. A concrete example of the liquid ejection apparatus may be a liquid ejection apparatus that ejects a liquid in the form of a dispersion or a solution containing a material such as an electrode material or a color material used for production of liquid crystal displays, EL (electroluminescent) displays, surface emission displays and color filters. The liquid ejection apparatus may also be a liquid ejection apparatus that ejects a bioorganic material used for manufacturing biochips, a liquid ejection apparatus that is used as a precision pipette and ejects a liquid as a sample, a printing apparatus or a microdispenser. Additionally, the liquid ejection apparatus may be a liquid ejection apparatus for pinpoint ejection of lubricating oil on precision machines such as machines and cameras or a liquid ejection apparatus that ejects a transparent resin solution of, for example, an ultraviolet curable resin, onto a substrate to manufacture a hemispherical microlens (optical lens) used for optical communication elements and the like. As another example, the liquid ejection apparatus may be a liquid ejection apparatus that ejects an acidic or alkaline etching solution to etch a substrate or the like.

REFERENCE SIGNS LIST

1, 100 liquid ejection system
3 printer
5 tank unit
6 first casing
7 second casing
9 tank
10 mechanism unit
11 paper ejection portion
13 front surface
15 top surface
17 operation panel
18A power button
18B operation button
19 side surface
21 window
23 front surface
25 top surface
27 side surface
28 upper limit mark
29 lower limit mark
31 mounting screw
32 support frame
33 mounting screw
41 printing assembly
43 supply tube
45 carriage
47 print head
49 relay unit
51 feed roller
53 motor
55 timing belt
61 casing
63 sheet member
64 joint portion
65 container portion
67 communicating portion
68 air chamber
73 communicating path
81 first wall
82 second wall

83 third wall
84 fourth wall
85 fifth wall
86 sixth wall
87 seventh wall
88 eighth wall
91 recess
99 recess
101 ink inlet portion
105 extended portion
105A, 105B, 105C, 105 region
108 groove
109 recess
111 ninth wall
112 tenth wall
113 eleventh wall
115 connection structure
116 supply port
117 air communication structure
118 air communication port
121, 122 communication port
125 partition wall
125A first partition wall
125B second partition wall
127 bent part
128 cutout
129 cutout
131 recess
132 opening
133 side wall
141 ink
143 cap
151 partition wall
153 intersecting part
155 area
157, 157A, 157*b* area
500 multifunction printer
503 printer
505 scanner unit
507 casing
511 mechanism unit
512 operation panel
513 power button
514 operation button
515 window
P printing medium

The invention claimed is:

1. A liquid container, comprising:

a liquid container portion configured to contain a liquid to be supplied to a head that ejects liquid; and a liquid inlet portion, through which the liquid is received into the liquid container portion, the liquid container portion in a state of supplying the liquid to the head, comprising a bottom wall;

a liquid inlet portion forming wall which is located above the bottom wall and provided with the liquid inlet portion;

a visual recognition wall extending in a direction that intersects with the bottom wall and the liquid inlet portion forming wall, the visual recognition wall allowing the liquid in the liquid container portion to be externally recognized;

an opposing wall opposed to the visual recognition wall; and a wall located between the bottom wall and the liquid inlet portion forming wall, the wall extending toward the opposing wall in a direction that intersects with the visual recognition wall, and having an end portion apart from the opposing wall and the bottom wall, wherein the liquid inlet portion is located nearer to the visual recognition wall than the opposing wall, and the end portion of the wall is located nearer to the opposing wall than the visual recognition wall.

2. The liquid container according to claim 1, wherein the visual recognition wall is provided with a lower limit mark indicating a lower limit of a liquid amount in the liquid container portion.

3. The liquid container according to claim 1, wherein the visual recognition wall is provided with an upper limit mark indicating an upper limit of a liquid amount in the liquid container portion.

4. The liquid container according to claim 1, wherein at least part of the visual recognition wall has liquid repellency.

5. A printer comprising:

the liquid container according to claim 1; and the head, wherein the liquid container is placed in a case of the printer, and the case has a window portion opposed to the visual recognition wall of the liquid container.

6. The printer according to claim 5, wherein the window portion is provided in front of the printer.

7. The printer according to claim 5, wherein the case has an operation panel in front of the printer.

8. A multifunction device comprising:

the printer according to claim 5; and a scanner unit, wherein the scanner unit is rotatably provided with respect to the case, above the printer.

* * * * *